US009127421B2

(12) United States Patent
Ball

(10) Patent No.: US 9,127,421 B2
(45) Date of Patent: Sep. 8, 2015

(54) BOLLARDS

(75) Inventor: Robert N Ball, Cheshire (GB)

(73) Assignee: ATG ACCESS LTD. (GB)

( * ) Notice: Subject to any disclaimer, the term of this patent is extended or adjusted under 35 U.S.C. 154(b) by 0 days.

(21) Appl. No.: 13/981,979

(22) PCT Filed: Jan. 27, 2012

(86) PCT No.: PCT/GB2012/050175
§ 371 (c)(1),
(2), (4) Date: Sep. 20, 2013

(87) PCT Pub. No.: WO2012/101451
PCT Pub. Date: Aug. 2, 2012

(65) Prior Publication Data

US 2014/0010591 A1 Jan. 9, 2014

(30) Foreign Application Priority Data

| | | |
|---|---|---|
| Jan. 28, 2011 | (GB) | 1101513.8 |
| Jan. 28, 2011 | (GB) | 1101514.6 |
| Mar. 22, 2011 | (GB) | 1104802.2 |
| Aug. 1, 2011 | (GB) | 1113211.5 |

(51) Int. Cl.
*E01F 15/00* (2006.01)
*E01F 13/00* (2006.01)
(Continued)

(52) U.S. Cl.
CPC ..... *E01F 15/003* (2013.01); *E01F 9/0117* (2013.01); *E01F 13/12* (2013.01)

(58) Field of Classification Search
CPC ..... E01F 15/003; E01F 9/0117; E01F 13/12
USPC ..... 404/6, 9, 10
See application file for complete search history.

(56) References Cited

U.S. PATENT DOCUMENTS

| | | | |
|---|---|---|---|
| 1,574,908 | A | 3/1926 | Lamp |
| 1,848,516 | A | 3/1932 | Davison |
| 2,006,233 | A | 6/1935 | Chretien |

(Continued)

FOREIGN PATENT DOCUMENTS

| | | |
|---|---|---|
| CH | 700218 | 7/2010 |
| DE | 2309249 | 8/1974 |

(Continued)

OTHER PUBLICATIONS

Search Report corresponding to Application No. GB1101513.8 dated May 26, 2011.

(Continued)

*Primary Examiner* — Abigail A Risic
(74) *Attorney, Agent, or Firm* — Niels Haun; Dann Dorfman Herrell & Skillman, PC

(57) ABSTRACT

A bollard apparatus for use as a vehicle barrier including one or more bollard members, and one or more separate foot members each adapted for ground engagement by placement upon (or shallow-mount embedment within) a ground or floor surface. To each of the foot members is fixed at least one bollard member upstanding therefrom. At least one collar member is positioned within a respective through-opening in a respective foot member wherein the collar member is fixed to the base end of a bollard member and circumscribes the bollard member thereat. The collar member is upstanding from the surface of foot member from which the bollard number is also upstanding.

18 Claims, 31 Drawing Sheets

(51) Int. Cl.
*E01F 9/011* (2006.01)
*E01F 13/12* (2006.01)

(56) References Cited

U.S. PATENT DOCUMENTS

| | | | | |
|---|---|---|---|---|
| 2,263,649 | A | 11/1941 | Sawyer | |
| 3,810,595 | A | 5/1974 | Doolittle | |
| 3,861,097 | A | 1/1975 | Patterson | |
| 4,240,766 | A | 12/1980 | Smith et al. | |
| 4,576,508 | A | 3/1986 | Dickinson | |
| 4,844,653 | A | 7/1989 | Dickinson | |
| 4,919,563 | A | 4/1990 | Stice | |
| 4,973,189 | A | 11/1990 | Bechtold | |
| 5,474,017 | A | 12/1995 | Mohebbi | |
| 5,481,828 | A | 1/1996 | Kentrotas | |
| 5,547,310 | A | 8/1996 | Muller | |
| 5,829,912 | A | 11/1998 | Marcotullio | |
| 5,975,792 | A | 11/1999 | Goeken | |
| 6,174,103 | B1 | 1/2001 | Stroman | |
| 6,435,760 | B1 | 8/2002 | Pettesch | |
| 6,626,606 | B1 | 9/2003 | Johnson | |
| 7,244,075 | B2 * | 7/2007 | Stadler | 404/6 |
| 7,607,856 | B2 * | 10/2009 | Patel | 404/6 |
| 7,850,391 | B2 * | 12/2010 | Omar | 404/6 |
| 8,096,727 | B2 * | 1/2012 | Parenti et al. | 404/6 |
| 8,197,156 | B2 | 6/2012 | Morgan | |
| 8,215,865 | B2 | 7/2012 | Adler | |
| 8,277,143 | B2 | 10/2012 | Adler | |
| 8,523,479 | B2 | 9/2013 | Adler | |
| 2003/0051406 | A1 | 3/2003 | Ritz | |
| 2003/0145498 | A1 | 8/2003 | Venegas, Jr. | |
| 2004/0091315 | A1 | 5/2004 | Yodock | |
| 2004/0151542 | A1 * | 8/2004 | Johnson | 404/6 |
| 2004/0159055 | A1 | 8/2004 | Stone | |
| 2005/0031411 | A1 | 2/2005 | Hensley | |
| 2005/0073275 | A1 | 4/2005 | Robb | |
| 2005/0098770 | A1 | 5/2005 | Schell | |
| 2006/0204327 | A1 * | 9/2006 | Phelan | 404/6 |
| 2006/0233608 | A1 | 10/2006 | Netah | |
| 2007/0031189 | A1 | 2/2007 | Stadler | |
| 2007/0086858 | A1 | 4/2007 | Morgan | |
| 2007/0258762 | A1 * | 11/2007 | Stice | 404/6 |
| 2008/0038056 | A1 | 2/2008 | Patel | |
| 2008/0038057 | A1 * | 2/2008 | Stadler | 404/6 |
| 2008/0112756 | A1 | 5/2008 | Omar | |
| 2008/0187396 | A1 | 8/2008 | McCue | |
| 2009/0047066 | A1 | 2/2009 | Stice | |
| 2009/0202296 | A1 | 8/2009 | Lamore | |
| 2009/0208285 | A1 * | 8/2009 | Adler et al. | 404/6 |
| 2009/0250674 | A1 | 10/2009 | Darcy | |
| 2010/0166498 | A1 * | 7/2010 | Adler et al. | 404/6 |
| 2010/0290832 | A1 | 11/2010 | House | |
| 2011/0033232 | A1 * | 2/2011 | Adler et al. | 404/6 |
| 2012/0230764 | A1 * | 9/2012 | Lafont | 404/6 |
| 2012/0251236 | A1 * | 10/2012 | Hild et al. | 404/6 |
| 2012/0308302 | A1 | 12/2012 | Adler | |
| 2013/0034387 | A1 | 2/2013 | Adler | |
| 2014/0003867 | A1 | 1/2014 | Ball | |
| 2014/0010591 | A1 | 1/2014 | Ball | |
| 2014/0017003 | A1 | 1/2014 | Ball | |
| 2014/0119825 | A1 | 5/2014 | Castro | |
| 2014/0147201 | A1 | 5/2014 | Ball | |
| 2014/0161521 | A1 | 6/2014 | Ball | |
| 2014/0161523 | A1 | 6/2014 | Ball | |

FOREIGN PATENT DOCUMENTS

| | | | |
|---|---|---|---|
| DE | 3605747 | | 8/1987 |
| DE | 9316170 | | 3/1994 |
| DE | 9315671 | | 6/1994 |
| DE | 19631678 | | 2/1998 |
| DE | 19812116 | | 9/1999 |
| DE | 19815426 | | 10/1999 |
| DE | 202005013439 | | 11/2005 |
| DE | 102007052321 | A1 | 5/2009 |
| EP | 0176973 | | 4/1986 |
| EP | 369860 | | 5/1990 |
| EP | 1530921 | | 5/2005 |
| EP | 1541768 | A1 | 6/2005 |
| EP | 2161377 | | 3/2010 |
| EP | 2306034 | | 4/2011 |
| FR | 002598484 | | 11/1987 |
| FR | 2598484 | | 11/1987 |
| FR | 2621625 | | 4/1989 |
| FR | 2680190 | | 7/1993 |
| FR | 2686633 | | 7/1993 |
| FR | 002688244 | | 9/1993 |
| FR | 2721629 | | 12/1995 |
| FR | 2743097 | | 7/1997 |
| FR | 2759102 | | 8/1998 |
| FR | 2775992 | | 9/1999 |
| FR | 2785308 | | 5/2000 |
| FR | 2793821 | | 11/2000 |
| FR | 2814181 | | 3/2002 |
| FR | 28141181 | | 3/2002 |
| FR | 2851586 | | 8/2004 |
| FR | 2851587 | A1 | 8/2004 |
| FR | 2925080 | | 6/2009 |
| FR | 2929627 | | 10/2009 |
| FR | 2945300 | | 11/2012 |
| GB | 140262 | | 3/1920 |
| GB | 0997053 | | 6/1965 |
| GB | 1256889 | | 12/1971 |
| GB | 1426947 | | 3/1976 |
| GB | 2125084 | | 2/1984 |
| GB | 2178094 | | 2/1987 |
| GB | 2178094 | A | 2/1987 |
| GB | 2267923 | | 12/1993 |
| GB | 2285826 | | 7/1995 |
| GB | 2372065 | | 8/2002 |
| GB | 2443631 | | 5/2008 |
| GB | 2467411 | | 8/2010 |
| GB | 2485278 | | 5/2012 |
| GB | 2487582 | | 8/2012 |
| GB | 2490118 | | 10/2012 |
| GB | 2493353 | | 2/2013 |
| JP | 2007016476 | | 1/2007 |
| JP | 2009097244 | | 5/2009 |
| WO | 97/09485 | | 3/1997 |
| WO | 9709485 | | 3/1997 |
| WO | 2004048702 | | 6/2004 |
| WO | 2004099534 | | 11/2004 |
| WO | 2007001326 | | 1/2007 |
| WO | 2007008813 | | 1/2007 |
| WO | 2007018531 | A1 | 2/2007 |
| WO | 2007191977 | | 8/2007 |
| WO | 2007103394 | | 9/2007 |
| WO | 2009/112159 | | 9/2009 |
| WO | 2010132616 | | 11/2010 |
| WO | 2013017837 | | 2/2013 |

OTHER PUBLICATIONS

GB Combined Search and Examination Report corresponding to Application No. GB1214248.5 dated Aug. 29, 2012.
GB Search Report corresponding to Application No. GB1101514.6 dated May 27, 2011.
GB Combined Search and Examination Report corresponding to GB1214278.2 dated Dec. 10, 2012.
GB Search Report corresponding to GB1104802.2 dated May 25, 2012.
GB Search Report corresponding to GB1113211.5 dated Jan. 17, 2012.
International Search Report corresponding to PCT/GB2012/050175 dated May 23, 2012.
Written Opinion of the International Search Authority corresponding to PCT/GB2012/050176 dated May 21, 2012.
Written Opinion of the International Search Authority corresponding to PCT/GB2012/050173 dated May 22, 2012.
Written Opinion of the International Search Authority corresponding to PCT/GB2012/050175 dated May 23, 2012.
International Search Report corresponding to PCT/GB2012/050176 dated May 21, 2012.

(56) References Cited

OTHER PUBLICATIONS

International Search Report corresponding to PCT/GB2012/050173 dated May 22, 2012.
GB Combined Search and Examination Report corresponding to GB1214276.6 dated Mar. 19, 2013.
GB Examination Report corresponding to GB 1214276.6 dated Jul. 22, 2013.
GB Search Report corresponding to GB 1113203.2 dated Jan. 25, 2012.
GB Search Report corresponding to GB1109010.7 dated Sep. 16, 2011.
GB Search Report corresponding to GB1214276.6 dated Nov. 17, 2012.
International Search Report corresponding to Application No. PCT/GB2012/051755 dated Mar. 12, 2013.
International Search Report corresponding to PCT/GB2012/051198 dated Aug. 30, 2012.
Written Opinion of the International Searching Authority corresponding to PCT/GB2012/051198 dated Aug. 30, 2012.
Written Opinion of the International Searching Authority corresponding to PCT/GB2012/051755 dated Mar. 12, 2013.
Search Report with abstracts and figures Aug. 18, 2010.
Search Report with abstracts and figures Aug. 19, 2010.
Search Report with abstracts and figures Aug. 19, 2010-bis.
Search Report with abstracts and figures Aug. 20, 2010.
Search Report with abstracts and figures Oct. 2, 2010.
Search Report with abstracts and figures Mar. 23, 2015.

* cited by examiner

BOLLARDS

RELATED APPLICATIONS

This application is a 371 application of International Application No. PCT/GB2012/050175 filed Jan. 27, 2012, which claims priority to United Kingdom Patent Application No. 01113211.5 filed Aug. 1, 2011 and United Kingdom Patent Application No. 01104802.2 filed Mar. 22, 2011 and United Kingdom Patent Application No. 01101514.6 filed Jan. 28, 2011 and United Kingdom Patent Application No. 01101513.8 filed Jan. 28, 2011. Each of the foregoing applications is hereby incorporated herein by reference.

BACKGROUND

1. Technical Field

The invention relates to bollards. In particular, though not exclusively, the invention relates to vehicular impact barriers and bollards suitable for use in vehicular impact barriers.

2. Description of Related Art

The provision of barriers comprising bollards, particularly vehicle barriers, often requires the permanent fixture, embedding or foundation of bollards within a ground surface in order to provide sufficient robustness and resilience of permanency to the barrier. It is very common that bollards arrayed collectively to provide such a barrier on a ground surface require some degree of excavation into that ground surface to enable each individual bollard of the barrier to be firmly, fixedly and permanently set into the ground to be upstanding from it. This is costly, time consuming and damaging to existing ground surfaces. For example an existing ground surface may comprise a paved area or may comprise a floor surface which is not in immediate contact with the ground, such as an elevated floor surface (e.g. a concrete floor) within an upper level of a building such as a car park or airport terminal building or the like. Excavating such a floor surface in order to accommodate embedded bollards is extremely undesirable. Structural integrity maybe compromised and the embedding of suitably robust bollards may not be feasible or permissible.

These problems are compounded when the situation requires only temporary placement of a barrier. In those circumstances, subsequent re-excavation of the embedded bollard members would be required in order to remove the barrier. Subsequent repair of the ground surface or floor surface would be required where excavation had taken place.

Furthermore, when the embedding of barriers within an excavation is required, the existence of obstacles to the intended positioning and linear trajectory of parts of the barrier may prevent the necessary excavation being provided. Additionally, sharp turns in the trajectory of the barrier may be required to avoid obstacles (e.g. street furniture) or to follow a desired arcuate route (e.g. a turn in a pavement).

The present invention aims to provide means and methods which may be used desirably to assist in addressing some or all of the problems identified above, while still providing a robust and effective barrier able to absorb vehicular impact forces efficiently.

SUMMARY OF THE INVENTION

According to the present invention there is provided an apparatus and method preferably as set forth in the appended claims. Other features of the invention will be apparent from the dependent claims, and the description which follows.

In a first of its aspects, the invention may provide a bollard apparatus for use as a vehicle barrier including: one or more bollard members; one or more separate foot members each adapted for ground engagement by placement upon (or shallow-mount embedment within) a ground or floor surface, to each of which is fixed at least one said bollard member upstanding therefrom; at least one collar member positioned within a respective through-opening in a respective foot member wherein the collar member is fixed to the base end of a bollard member and circumscribes the bollard member thereat and wherein the collar member is upstanding from the surface of foot member from which the bollard number is also upstanding. The collar member may be fixed to the base end of a bollard member at its base end. The fixing may be by welding, cementing, adhesion or by the use of fixing members (e.g. rivets, screws, bolts etc), between collar and bollard. Preferably the fixing is substantially permanent.

A collar member may define a bore along which the bollard member is fitted and embraced, wherein the outer diameter of the collar member at parts adjacent the head end of the bore furthest from the through-opening, is less than the outer diameter at parts thereof adjacent the through-opening. Preferably, the outer diameter of parts of the collar member decrease with increasing proximity to the head end thereof progressively, thereby to define a tapering. The diameter of the bore is preferably uniform. The collar member may be solid in construction.

The bollard apparatus may comprise a plurality of such bollard members each bearing a collar member positioned within a respective through-opening in a respective foot. The bollard apparatus may provide a vehicle impact barrier or a part thereof. The invention may be provided as a kit of part for assembly into a bollard apparatus.

The bollard apparatus may include a plurality of bollard members; a plurality of separate foot members each adapted for ground engagement by placement upon (or embedment within) a ground or floor surface, to each of which is fixed at least one said bollard member upstanding therefrom.

Each foot member preferably is adapted to lie across a ground or floor surface to present a relatively large interface area defining a foot print which is significantly greater than the cross-sectional area of any of the bollards attached to the foot member. This enhances frictional ground contact. A foot member may comprise a substantially flat plate, or other flat structure, which extends in directions transverse to the length of the bollard(s) attached to it. A foot member preferably is significantly wider and/or longer than it is thick, i.e. a relatively thin structure such that the foot member presents a minimal vertical height/depth when laid on (or embedded within) the ground.

This aims to minimise the degree of vertical obstruction the foot member presents. A foot member may be shaped to present a substantially rectangular (e.g. square) footprint. Other shapes may be adopted.

A foot member may so extend for a distance less than, or substantially equal to, or exceeding the length of a bollard upstanding from it. In this way, a bollard member may be attached to a transverse foot member which is less wide/long, or is about as wide/long, or is wider/longer than the bollard is tall. The or each bollard member may be attached to an associated foot member at a position upon the foot member such that, at least in one direction, parts of the foot member extend away from one side of the bollard member fixed to it for a distance less than, or substantially matching, or exceeding the upstanding length of that bollard. Each bollard may be longer than the width of the foot member to which it is attached, or each bollard may be shorter than the width of the foot member to which it is attached.

The bollard or bollards attached to a foot member are preferably offset to one side of a surface of the foot member (e.g. a plate). The periphery of the foot member to which the bollard members are closest may be considered to be at the front of the bollard apparatus and the periphery of the foot member furthest from the bollard members can be considered to be at the rear of the bollard apparatus. In use, it is the front of the bollard apparatus which may most desirably be presented in a direction from which vehicular impact is to be expected. Impact forces applied transversely to bollard members at the front of the bollard apparatus may urge the bollard members to tip away from the impacting vehicle, and this tipping movement is at least partly resisted by the parts of the foot member extending towards the back of the bollard apparatus away from the impacting vehicle.

Bollards may be inclined relative to the plane of the foot member to which they are fixed. This may be to take account of inclined ground surfaces such that when the foot member is laid upon it in use, the bollards of that foot member are substantially vertical in orientation. There may be other reasons to incline the bollards relative to their foot member according to design preferences.

Desirably, at least one flexible coupling line may pass from at least one said foot member to at least one other said foot member thereby to couple separate said foot members such that impact forces inducing movement in one coupled foot member are transmissible to another coupled foot member via the at least one flexible coupling line.

Preferably, at least one said flexible coupling line is adapted to be substantially taut in use. Tautness in the coupling line or lines enables substantially immediate transmission of impact forces experienced by any one of the bollard members to be transmitted to other bollard members on other separate foot members when the impact results in movement of a foot member. The foot members may be evenly spaced and bollard members attached to separate foot members may also be evenly spaced. The spacing between successive foot members may be such as to ensure the space between adjacent bollard members of successive foot members matches the spacing between successive bollard members on a given common foot member. Alternatively, the successive foot members may be abutted to each other, side-by-side, or generally as close as is possible whilst still permitting space for coupling lines to pass between foot members as desired.

The bollard apparatus in preferred embodiments may be arranged such that the at least one coupling line extends between opposing edges of neighbouring successive foot members of the bollard apparatus (e.g. from one opposed edge to another edge opposing it). The at least one coupling line may be attached at to each of the foresaid opposing edges. The at least one coupling line preferably comprises two ends (e.g. terminal ends) each one of which is attached to a respective one of the aforementioned opposing edges of neighbouring successive foot members. The at least one coupling line preferably extends between no more than two neighbouring successive such foot members. The at least one coupling line may be attached to two neighbouring successive foot members at respective attachment means (e.g. an attacher(s)). A bollard of one of the foot members is preferably positionable to be spaced from a nearest opposing bollard of a neighbouring foot member along a spacing direction substantially parallel to the direction along which the respective attachment means of a coupling line are concurrently spaced.

The at least one coupling line preferably extends between opposing edges (e.g. straight edges, or otherwise) of neighbouring feet. It is preferably connected (e.g. removeably connected) at its ends to a respective one of the opposing edges. The at least one coupling line may be attached at one end to one foot member and the other end to the other, neighbouring, foot member. In this way the at least one coupling line may be attached at each of its ends to a respective one of two neighbouring foot members. Alternatively, the coupling line may comprise a closed-loop line which loops around attachment means at neighbouring opposing edges of two foot members to couple the two foot members together.

In preferred embodiments, the at least one coupling line extends between only two neighbouring foot members. The bollard apparatus may comprise a succession of a foot member followed by an at least one coupling line attached (e.g. at an end) to an edge of the foot member, there then following a further foot member to which the (e.g. other end of the) at least one coupling line is attached at an opposing edge of the other foot member. Subsequently there may then follow a yet further at least one coupling line attached to a separate edge of the other foot member (e.g. an edge at an opposite end of the other foot member) at, for example, a first end of the yet further at least one coupling line wherein, for example, the second end of the yet further at least one coupling line is attached to an opposing edge of a yet further foot member. This sequence of: foot member—at least one coupling line—foot member, may be repeated as often as desired to generate a barrier comprising a plurality of bollard-bearing foot members mutually coupled by an intervening at least one coupling line passing between (e.g. from and to) opposing edges of neighbouring foot members.

Regarding two separated successive foot members, a bollard member of one given foot member may be positioned upon that foot member to be spaced from a nearest bollard of a neighbouring foot member along a direction, axis or line of separation substantially parallel to the direction of the spacing, axis or line of separation between those places on the two foot members where an at least one coupling line is attached to each of the respective neighbouring foot members. The coupling line(s) may be attached to a foot member by attachment means which link, couple or join the coupling line to the foot member in question. If the coupling line(s) is a chain, or other line terminating with a link, loop, hook or the like, then the attachment means may comprise an eye, eyelet, through-opening, hook or latch into which the termination of the coupling line may link, couple or attach. The attachment means may comprise a pin, rod, bar or shaft mounted or attached to an edge of the foot member in question so as to extend in spaced separation from that edge generally transversely to the direction of the coupling line attached to it (e.g. generally substantially parallel to the edge of the foot member). The spaced separation preferably admits the parts of (e.g. the terminal end of) the coupling line required to form the linkage therewith. The means by which the pin, rod, bar, arm or shaft is so mounted may determine the degree of separation from the edge of the foot member. For example, a conduit or at least one pair of spaced successive conduits may be fixed (e.g. welded) to the edge of the foot member. The conduit(s) may be steel or other suitable metal. The conduits may comprise conduit bores arranged so as to admit and preferably hold parts of the pin, rod, bar, arm or shaft and to concurrently expose a part thereof. Where successive pairs of spaced conduits are employed, the respective conduit bores may be in register coaxially. The parts of the pin, rod, bar, arm or shaft located in the space between the spaced conduits of such a pair is thereby exposed. Consequently, different parts of the same pin, rod, bar, arm or shaft may be held within successive spaced conduits and part of the same pin, rod, bar, arm or shaft extending between successive spaced conduits may be exposed to allow them to attach to a coupling line.

The exposed part of the pin, rod, bar, arm or shaft, together with the conduit (or conduits of a pair) form with the edge of the foot member a means for the coupling line to link to or around to couple to the foot member. The pin, rod, bar, arm or shaft is preferably slidingly removeable and insertable into one, some or all of the conduit bore(s). The attachment means may comprise a plurality of separate (and separable) such pins, rods, bars, arms or shafts which may be insertable and removeable one after the other, or independently, along one some or each conduit. For example, where there are a plurality of spaced conduits, they may be arranged with their conduit axes (e.g. bores, if the conduit is a tube) in coaxial register. A common one pin, rod, bar, arm or shaft may be removeably insertable in common to link multiple coupling lines in tandem to a common edge of a foot member. Alternatively, several shorter pins, rods, bars, arms or shafts may be removeably insertable in succession to form a collinear length along the axially registered conduit bores. Other arrangements for attachments means are possible.

The foot members of a bollard apparatus and the at least one bollard members attached to them are preferably arranged such that opposing edges of the foot parts, when positioned in spaced opposition, are such that the two near most bollards of neighbouring foot members are positionable in register to concurrently place in register those places on the opposing edges of neighbouring foot members at which a (e.g. any or all) given at least one coupling line is attached to mutually couple the neighbouring foot members.

Preferably, the at least one coupling lines are removable attached to, or are adapted to be removable attached to, said opposing edges via attachment means located at each respective opposing edge. Preferably the opposing attachment means associated with an at least one coupling line are mutually laterally offset from the two opposing near most bollards of the neighbouring foot members when those opposing bollards are in register. Preferably, for example, the attachment means associated with at least one coupling line, and attached to opposing edges of neighbouring foot members, are not both located (or positionable to be both located) between the opposing near most neighbouring bollards of the neighbouring foot members. Preferably, the attachment means associated with at least one coupling line are closer to the rear edge of the foot member than to the front edge of the foot member. Note that references herein to the "rear" and "front" of a foot member are synonymous with the front and rear of the bollard apparatus, or barrier unit, as described above and subsequently.

Preferably the attachment means of the opposing edges, associated with a coupling line, are offset towards a rear edge of the respective foot members to which they are attached whereas the opposing near most bollard members are preferably positioned closer to or near most the front edge of each foot member. Preferably each foot member comprises a plurality of attachment means arrayed along an edge of the foot member to form an array adapted to oppose and be positioned in register with a corresponding array of a plurality of attachment means connected to an opposing edge of a neighbouring foot member. The two arrays of attachments means are preferably arranged such that each attachment means of a given one array can be concurrently placed in register with a corresponding respective opposing attachment means when the near most opposing bollard members of the neighbouring foot members are also placed in register. In this way each one of the two attachment means defining one of a plurality of separate pairs of opposing attachment means, as between opposing edges of neighbouring foot members, may be brought into concurrent register when the near most opposing bollards of the neighbouring foot members are also brought into register.

It is preferably that at least one such pair of opposing attachment means is closer to the rear of the bollard assembly while the opposing near most bollard members are closer to the front of the bollard assembly. A second such pair of opposing attachment means may be provided and these are preferably located along the aforementioned opposing edges of the two neighbouring foot members in between the rear most pair of opposing attachment means and the opposing nearest bollard members. Alternatively each one of the second pair of attachment means may be fixed to a respective opposing edge of the pair of neighbouring foot members near most the bollard member attached to that foot member. The result is that when the nearest opposing bollard members are brought into register, so to are the opposing attachment members of the second pair of attachment members in between the two opposing nearest bollard members. Preferably, at least two pairs of opposing attachment means are provided so as to be closer to the rear of the foot members than is a near most bollard of that foot member. The result is that preferably at least one coupling line extends between neighbouring foot members between opposing edges adjacent or nearer to the rear of each foot member than are their associated bollard members. More preferably two such separate coupling lines are attached in this way, and preferably at least a third coupling line couples the opposing edges in the space generally directly between the opposing near most bollards of the neighbouring foot members.

It has been found that when a vehicle impacts a bollard apparatus comprising a coupled pair of neighbouring foot member and bollards, opposing edges of neighbouring foot members tend to be urged to splay such that the separation of those parts of opposing edges towards the rear of the bollard apparatus is urged to be greater than that between the opposing edges towards the front of the apparatus. Attaching a coupling line, or a greater proportion of coupling lines towards to the rear parts of opposing edges has been found to be more effective in resisting and absorbing impact forces. In addition, torque applied by an impacting vehicle to an upstanding bollard member often tends to urge the associated foot member to pivot at its rear most edge in such a way as to lift the front edge (near most the impacted bollard and the impacting vehicle) upwardly. By placing an at least one coupling line between neighbouring foot members towards to the front edge of the bollard apparatus, impact energies conveyed by this torque effect are efficiently transferred laterally from the impacted bollard member to neighbouring foot members and onwardly to any additional foot members subsequently coupled to that neighbouring foot member along the array of the bollard apparatus.

Preferably, the one or more coupling lines are adjustably attached to the attachment means. For example, it/they may be slidingly, rotatably or pivotably attached. The benefit is that when tension is applied to a coupling line it may most preferably be sufficiently self-adjustable to adopt a straight configuration between those parts of the two foot parts between which it extends so as to extend directly. For example, the/a coupling line may be a chain. Each terminal chain link of the chain may have a through-opening through which a rod, pin, arm or bar of the attachment means passes or is arranged to be passed. The attachment means may preferably be dimensioned to admit a terminal chain link attached thereto to pivot about the rod, pin, arm, or bar of the attachment means to which the link is attached, or is arranged to be attached.

Preferably the attachment means is arranged to substantially restrain, restrict or fix the location at which an end(s) of the at least one coupling line is positioned relative to the foot member to which it is attached or arranged to be attached. This may be achieved by providing the attachment means with obstruction parts or portions which prevent movement of the attached end of the coupling line beyond them. For example, an obstruction part(s) may be located upon a said rod, pin, arm, or bar of the attachment means to which the link is attached, or is arranged to be attached to prevent, restrict of restrain movement of the end of the coupling line therealong. The obstruction parts may be provided by said one or more conduits. When there are a plurality of separate spaced conduits, they may preferably be arranged to prevent, restrict of restrain movement of the end of the coupling line in either direction therealong. The benefit of this is that the intended location at which a coupling line is to bear/transmit impact forces imparted to a barrier unit cannot be unintentionally or inadvertently altered.

Desirably, the at least one flexible coupling line is secured to anchor means (e.g. an anchor(s)) adapted to engage said ground or floor surface and to inhibit or restrain movement of the coupling line thereat. The anchor means may comprise one or more anchor members selected from: fixture means (e.g. a fixer(s)) adapted for ground penetration or embedment thereby to provide a fixture thereat; and, weight means (e.g. a weight(s)) adapted for surface placement and comprising a body of weight sufficient to render it substantially immovable manually. An anchor member may comprise a foot member including bollard members. For example, one or each of the terminal foot members in a bollard apparatus may be dimensioned to be significantly larger and heavier than other foot members within the bollard apparatus so as to much more significantly resist movement by virtue of its significantly greater inertial mass and frictional interface with the ground or floor surface upon which it is placed. The bollard members and foot members of a bollard apparatus may be formed from steel and a bollard apparatus may weigh several tons. The benefit of generally restraining movement, more particularly at terminal foot members of a bollard apparatus, is to promote a circumstance in which movement, resulting from vehicular impact, of intermediate foot members in a vehicle barrier induces a tensile stretching of the coupling line(s) resulting from initial movement of impacted (and coupled) foot members—because the terminal ends of the coupling lines move little or mot at all—thereby to effectively absorb and disperse impact forces. This is particularly so when the terminal ends of a coupling line are secured to the terminal foot members. Alternatively, the coupling lines may be secured to separate ground-penetrating or embedded fixtures such as posts, bolts or other rigidly ground-fixed elements which provide for the immobility of the ends of the coupling line(s). Where terminal foot members are not used as anchor means, other large and weighty masses may be employed such as concrete blocks which may weigh at least one or several tons.

Preferably, the at least one flexible coupling line forms along portions thereof a sliding interface with foot members coupled thereby so as to permit relative movement therebetween. This sliding interface preferably permits elastic or tensile stretching in the coupling line in response to impact forces imposed upon the vehicle barrier which assists in absorbing and dislocating impact energies without impeded by points of fixture between the terminal ends of the coupling line. Any such points of fixture may otherwise serve as a high stress point where cable snap or breakage or damage may be more likely to occur than is the case where sliding movement is permitted. This sliding movement also enables sliding movement of foot members either linearly or in a twisting fashion across the ground or floor surface in response to impact forces which in turn pulls or pushes at the coupling line(s) transversely to the line so as to subsequently transversely pull, push or rotate neighbouring coupled foot members of the barrier.

A coupling line may be arranged to pass along and between each said foot member coupled thereby to one side of all bollards of the coupled foot members without passing between those bollards. For example, a coupling line may pass only along the rear of a barrier along those edges of the foot members of the barrier furthest from the bollards of the barrier. This provides a line against which any impacted bollard member, and attached foot member, will be pushed when impacted by a vehicle at the front of the barrier. The taut coupling line may resist this pushing motion and serve to restrain further such pushed movement. It may also effectively act to induce a pivoting or tippling movement of the impacted foot member around the edge of the foot member engaging the coupling line. The result may be a tendency of the pivoted foot member to dig into the ground surface at that pivoting edge to much more significantly resist further sliding movement. Alternatively or additionally, a coupling line may pass along the front of a barrier in order to assist in retaining the multiple foot members of the barrier assembly in their required positions.

A coupling line may be arranged to pass along successive said foot members coupled thereby at opposite successive sides of the bollards of successive of the coupled foot members, passing between bollards. Such a serpentine or slalom pass of a coupling line between foot members helps not only to transfer any transverse pushing movement of one foot member into a transverse pulling movement against neighbouring foot members, but also may serve to translate a rotation of one foot member into an oppositely-directed rotation in neighbouring foot members. This is particularly effective in transferring transverse impact forces laterally along the length of the barrier.

A foot member may preferably extend in a direction transverse to the bollards fixed thereto from a proximal edge to a distal edge further from the bollards than is the proximal edge. A coupling line may extend along said proximal edge. Alternatively, or additionally, a coupling line extends along said distal edge. Alternatively, or additionally, a coupling line extends alternately along a said proximal edge and a said distal edge in alternating succession along successive said foot members. The bollards are preferably upstanding from the foot member between said proximal and distal edges.

The bollard apparatus may include connector means (e.g. a connector(s)) at or adjacent the distal edge adapted to engage with the foot member thereat, the connector means being arranged concurrently to engage said ground or floor surface to connect the foot member thereto. For example, one or more bolts, pins, posts or other ground penetrating, or ground embedding, elements may be used. These elements may impede, or to some extent resist or obstruct sliding movement of the foot member with which they engage. Relatively small and modest ground-penetrating elements have been found to be very effective in retaining a bollard apparatus and barrier in place during an impact event, thus greatly reducing ground disturbance or damage. Much impact energy tends to be dissipated along the barrier due to the coupling line(s) and foot members, leaving much less energy acting against the connector means. The bollard apparatus may include connector means adapted to engage with one some or each said foot member and concurrently to engage said ground or floor surface to connect the foot member thereto.

Preferably, successive of the separate foot members are separated by a space, physical separation or gap. Alternatively, foot members may be abutted in a side-by-side arrangement. One or more coupling lies may pass directly, or diagonally, across the spaces as they pass from one foot member to another. The bollard apparatus may comprise at least three separate foot members, mutually coupled by coupling lines. The terminal foot members may provide anchorages for the ends of the coupling lines. They may be much heavier than the individual intermediate foot member(s) and bollards so as to be more resistant to impact-induced movement.

Each foot member of the bollard apparatus preferably includes guide means (e.g. a guider(s)) adapted to determine or define the direction of travel of a said coupling line along the foot member and through or along which a said flexible coupling line passes. The guide means may include one or more conduits, ducts, pipes, tubes, loops, hoops, channels or grooves on the foot member for guiding one or more coupling lines along/through it.

The bollard apparatus may include shock absorber means (e.g. an absorber(s)) coupled to at least one flexible coupling line and adapted to absorb energy generated by tensile shock loads/forces applied along a coupling line. The shock absorber means may be a compressible structure (e.g. a crumple zone, a resiliently deformable structure such as rubber or elastic material, or a pneumatic element) adapted to compress to absorb shock loads applied to a coupling line.

One, some or each foot member may comprise a structure (e.g. a plate part) presenting a surface upper most in use, which is arranged to admit said at least one bollard member. The structure may comprise a through-opening through which a bollard passes from a lowermost side to and beyond the uppermost surface, in use. The bollard(s) may be welded in this through-opening, e.g. at the periphery of the through-opening desirably at both sides of the foot member. The bollard(s) may stand substantially perpendicularly to a foot member, or may be inclined thereto. Optionally, only one, or at least two bollard members are fixed to each separate foot member.

Preferably, the plurality of separate foot members forms an array in which each foot member is coupled to each other foot member by at least one common flexible coupling line. This maximises dissipation of impact energies by more effectively allowing it to propagate along the whole length of a barrier.

Preferably, the plurality of separate of foot members form an array the terminal foot members of which comprise more bollard members fixed thereto than are fixed to foot members intermediate the terminal foot members. The intermediate foot members may be smaller (e.g. of less length, size and/or weight). The terminal foot members may provide anchorages for the ends of the coupling lines. They may be much heavier than the individual intermediate foot member(s) and bollards so as to be more resistant to impact-induced movement.

The plurality of separate foot members may form an array of successive separate foot members uniformly spaced. The bollard members of the array may be also uniformly spaced.

Preferably, one, some or each separate foot member is formed from steel. Preferably, one, some of each at least one bollard member comprises a steel tube. Preferably, the at least one flexible coupling line is stretchable to dissipate energy transferred thereto by movement of foot members coupled thereby. Preferably, the at least one flexible coupling line comprises a cable or a wire or a chain or a rope or a cord, or any combination thereof. Preferably, the at least one flexible coupling line comprises steel cable, or a plurality of steel cables. Preferably, the at least one (e.g. each) coupling line is adapted to accept a shock load of up to 20 tons, or alternatively, within the range equal to or greater than 20 tons. For example the shock loading capacity of a (the) coupling line(s) may be in a range up to 1 ton, or up to 5 tons, up to 10 tons, or up to 15 tons, or up to 25 tons, up to 30 tons, or up to 50, or 100 tons. The appropriate choice may be made according to preference, for example, taking account of the number of coupling lines, the geometry of the coupling lines (paths) and the speed and weight of a vehicle a barrier is intended to resist. The nominal cross sectional diameter of the material of the coupling chains is about 16 mm but may preferably be between about 10 mm and 20 mm. Preferably the pitch of the links within a chain is about 48 mm, but may preferably be within the range of about 30 mm to 70 mm. The load capacity of each coupling chain is preferably between 5 tons and 15 tons and most preferably 10 tons or thereabouts. The breaking force of each coupling chain is preferably about 400 kN and is most preferably within the range of about 350 kN to 450 kN.

Where a coupling line comprises a chain, the chain may be one manufactured according to ISO 9001 standards. For example, a chain classified to standard OASTM A973/A973M-01 or EN818-2 may be used. The stress at loading capacity of a chain may be between about 150 $N/mm^2$ and 350 $Nmm^2$, such as 250 $N/mm^2$. The breaking stress of a chain may be between about 600 $N/mm^2$ and 1400 $N/mm^2$. The break elongation minimum of a chain may be between about 10% and 30%, or preferably between about 15% and 25%, such as about 20%.

It is intended that the invention may be sold in unassembled form, for assembly into the bollard assembly described above. In a second of its aspects, the invention may provide a kit of parts for a bollard apparatus as described above.

For example, the invention may provide a kit of parts for a bollard assembly for use, when assembled, as a vehicle barrier including: one or more bollard members; one or more separate foot members each adapted for ground engagement by placement upon (or shallow-mount embedment within) a ground or floor surface, to each of which at least one said bollard member is adapted to be fixed to be upstanding therefrom; at least one collar member adapted to be positioned within a respective through-opening in a respective foot member wherein the collar member is adapted to be fixed to the base end of a bollard member to circumscribe the bollard member thereat and wherein the collar member is adapted to be positioned upstanding from the surface of foot member from which the bollard number is also upstanding.

The kit may further comprise a plurality of bollard members; a plurality of separate foot members each adapted for ground engagement by placement upon a ground or floor surface wherein each foot member is adapted to have fixed thereto at least one said bollard member upstanding therefrom; at least one flexible coupling line adapted to pass from at least one said foot member to at least one other said foot member thereby to couple separate said foot members such that impact forces inducing movement in one coupled foot member are transmissible to another coupled foot member via the at least one flexible coupling line when so coupled.

The invention may provide a vehicle impact barrier comprising the bollard apparatus according to any preceding claim.

The invention may provide a method of assembling a vehicle barrier including: providing a plurality of separate foot members each adapted for ground engagement/embedment by placement upon a ground or floor surface (or an excavation therein), to each of which is fixed at least one bollard member upstanding therefrom with at least one collar member positioned within a respective through-opening in a respective foot member wherein the collar member is fixed to the base end of a bollard member and circumscribes the bollard member thereat and wherein the collar member is upstanding from the surface of foot member from which the bollard number is also upstanding; placing said plurality of separate foot members upon a ground or floor surface to form an array of separated such foot members The method may further comprise providing a flexible coupling line and passing the coupling line from at least one said foot member to at least one other said foot member thereby to couple separate said foot members such that impact forces inducing movement in one coupled foot member are transmissible to another coupled foot member via the at least one flexible coupling line.

The barrier apparatus, when comprising chains as the coupling line(s), may include a shock absorber apparatus comprising a compressible bearing member adapted and arranged for removable insertion between opposing bearing surfaces of successive connected links of a chain. The shock absorber may be use with a chain in order to permit the chain to absorb tensile shocks applied to it in use by virtue of the compressibility of the bearing member. This has been found to reduce the likelihood of breakage between chain links when the chain is subjected to longitudinal/tensile shock loading. A consequence of employing such shock absorber apparatus is that when a chain in question is intended to be used in circumstances where shock loads will occur, the shock-loading capacity rating of the chain need not be as high as would otherwise be required were the shock absorber(s) not employed. Or put another way, the shock-loading capacity rating of a chain may be increased when such shock absorbing apparatus is used.

Furthermore, such shock absorber apparatus may be employed to shorten the fully-extended length of a piece of chain. That is to say, by inserting the shock absorber apparatus in between neighbouring chain links, the result is to separate those opposing bearing surfaces which would otherwise be in direct contact (i.e. bearing against each other) when the chain is fully extended. Consequently, the neighbouring chain links are drawn further together. This shortens the overall length of the chain they are a part of. This is especially useful when fine adjustment of the overall length of a chain (measured when taught) is required, and when a length reduction is required less than that which would result from removing a terminal chain link.

The shock absorber apparatus preferably comprises one or more retention parts or portions separate from the bearing member and adapted and arranged (e.g. shaped) to engage at least one of the connected links at other than a said opposing bearing surfaces thereby to obstruct movement of the bearing member away from a position between the opposing bearing surfaces of the connected links when the bearing member is so positioned thereby to retain that position. For example, a retention part may be arranged to engage with a part of a chain link which is not within the loop or through-opening of that link, and preferably not within the loop or through-opening of either of the two connected links when the chain is fully extended. The shock absorber apparatus may comprise shaped surface parts adapted to correspond reciprocally with (i.e. in sympathy with) the shape of the surfaces (e.g. bearing surfaces) of the neighbouring chain links to permit an intimate interface therebetween in use. This helps retain the shock-absorber apparatus in place and also assists in the transfer of shock loads from a chain link to the shock absorber apparatus. A reciprocally shaped surface part may be saddle-shaped in form. For example it may define a generally concave profile in cross-section in a first plane (e.g. viewed at one side) and a generally convex profile when viewed in second cross-section perpendicular to and intersecting the first plane (e.g. viewed from above or below). This surface is most preferably in sympathy with the surfaces, preferably the bearing surfaces, of typical chain link forms. The bearing member may present two such reciprocally shaped and oppositely outwardly facing (not opposing) surface parts located at opposite ends of the bearing member. Each such surface is preferably shaped for abutment to a respective one of two opposing bearing parts of two neighbouring chain links concurrently.

The, or each, retention part may present at least one concave contact surface shaped to reciprocate outwardly-facing surface parts of a chain link which are not bearing surfaces and are not within, nor define, the through-opening of a chain link. Preferably two such concave contact surfaces are presented at opposite sides of the bearing member to interface with opposite parts of the loop of a chain link concurrently while the bearing member is located between opposing bearing surfaces of successive chain links.

The bearing member may comprise a shaft, rod, arm, pin or tube or the like which may be elongate in a curved or substantially straight manner. A retention part may be greater in diameter of size than is the thickness of the bearing member to which it is attached. For example, a retention part may comprise a bolus, cone, bulb, block of other expansion of the apparatus at or towards one of each terminal end thereof. Preferably a retention part is compressible (e.g. hollow) to reduce its lateral dimension to assist easier manual insertion and removal of the shock absorber apparatus from between successive chain links.

The shock absorber apparatus, or at least the bearing member thereof, may be formed from a resilient rubber or polymer material having a Shore Hardness of at least 50, and preferably at least 60 and more preferably at least 70 and yet more preferably at least 80. Alternatively, the bearing member may comprise a metal tube (e.g. steel) designed to crush or collapse laterally (i.e. in a direction across the bore of the tube) when subject to sufficiently high lateral forces via said opposing bearing surfaces of neighbouring chain links. The transverse width/diameter of the bearing member may be a value between about 5 mm and about 10 mm. Thus, each insertion of a shock absorbing apparatus in between chain links of a fully extended chain may thereby reduce the length of that chain by the same a value between about 5 mm and about 10 mm.

In another of its aspects, the invention may provide a bollard apparatus for use as a vehicle barrier comprising: one or more bollard members; a plurality of separate foot assemblies each adapted for ground engagement by placement upon, or embedment within, a ground or floor surface, to at least one of which is fixed at least one said bollard member upstanding therefrom; and each said foot assembly comprises a pair of opposed parallel plates separated by a plurality of coupling beams which are each fixed to both of the opposed plates and are sandwiched therebetween; wherein a pair of said coupling beams extend in parallel adjacent an edge of a foot assembly of the plurality of foot assemblies and define between them an a spacing accessible at said edge and adapted for receiving an end of a separate coupling beam extending adjacent an edge of a separate other said foot assembly; and a linkage member for linking each of said pair of coupling beams to an end of said separate coupling beam when so received thereby to couple the two foot assemblies.

Each coupling beam may comprise a through-opening and the linkage means (e.g. a linker(s)) may comprise a pin member adapted to extend concurrently through the through-openings of each of the coupling beams of the pair of coupling beams and of the separate coupling beam when so received.

Each foot assembly may comprise an aforesaid pair of coupling beams extending adjacent an edge thereof, and an aforesaid separate coupling beam extending adjacent a separate edge thereof.

Each foot assembly may comprise two separate aforesaid pairs of coupling beams extending adjacent a common edge thereof, and two aforesaid separate coupling beams extending adjacent a common separate edge thereof.

The bollard apparatus may comprise a foot assembly in which the coupling beams of the two separate said pairs of coupling beams are substantially mutually parallel, and the aforesaid two separate coupling beams are substantially mutually parallel.

The coupling beams of the aforesaid two separate pairs of coupling beams may extend in a direction oblique relative to the direction in which the aforesaid two separate coupling beams extend. This enables successive foot assemblies to be coupled in a non-linear (arcuate) array or path. Alternatively, or additionally, the coupling beams of the aforesaid two separate pairs of coupling beams may extend in a direction substantially parallel to the direction in which the aforesaid two separate coupling beams extend. This enables successive foot assemblies to be coupled in a linear array or path. The apparatus may comprise a mixture of foot assemblies enabling of these two types enabling linear and non-linear parts in an array of coupled foot assemblies forming a barrier.

In some embodiments, one of the pair of opposed plates of a foot assembly uppermost in use defines a through-opening through which a bollard member extends from within the space between the opposed plates so as to be upstanding from the surface of foot assembly uppermost in use.

A collar member may be fixed to the base end of at least one bollard member, and may circumscribe the bollard member thereat. The collar member may be positioned within the through-opening to be upstanding from the surface of foot assembly from which the bollard member is also upstanding.

Such a collar member may define a bore along which the bollard member is fitted. The outer diameter of the collar member at parts adjacent the head end of the bore (i.e. the parts furthest from the through-opening) may be less than the outer diameter at parts thereof adjacent the through-opening. This defines a tapering having the advantages described above.

The collar member may have the structure described above in respect of other aspects of the invention, and may be fixed to the foot assembly as described in any embodiment herein.

The bollard apparatus may define of vehicle impact barrier or a part thereof, e.g. comprising a plurality of coupled foot assemblies each comprising one or more bollards.

BRIEF DESCRIPTION OF THE DRAWINGS

For a better understanding of the invention, and to show how example embodiments may be carried into effect, reference will now be made to the accompanying drawings in which.

DETAILED DESCRIPTION OF THE EXAMPLE EMBODIMENTS

Figure 1:
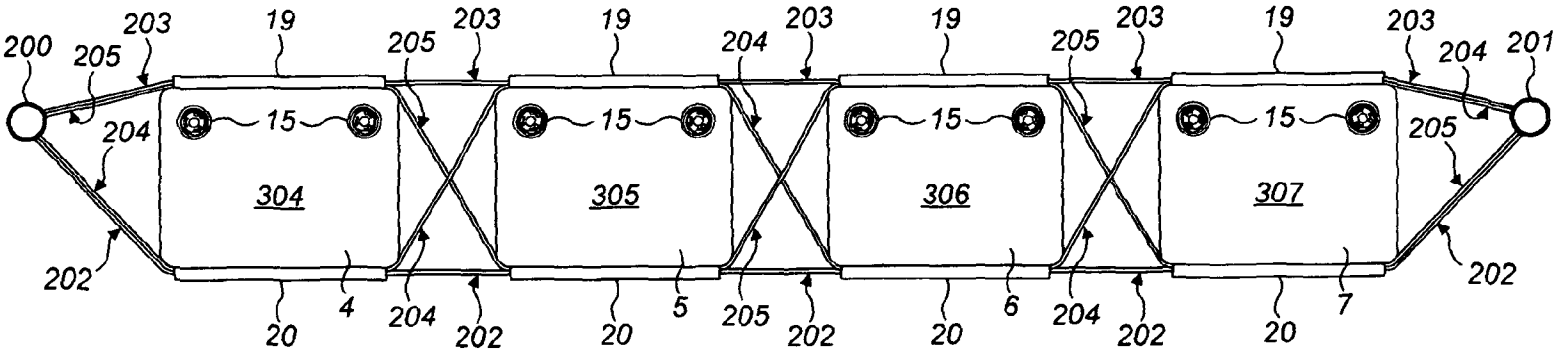
FIG. 1 shows a plan view of an embodiment of the invention in which coupling cables of a vehicle impact barrier are secured to a ground or floor surface at terminal ends of the barrier.

In the drawings like articles are assigned like reference symbols. The barriers of the following examples may be surface-mounted shallow-mounted in a shallow excavation within which a foot part is embedded.

FIG. 1 illustrates a vehicle impact barrier assembly (1) comprising an array of four separate and separated barrier units (304 to 307). Each barrier unit comprises a foot member (4,5,6,7) including a plate part formed from a steel plate being substantially rectangular in shape and adapted for ground engagement by placement of a lowermost plate surface upon a ground or floor surface. Each of the separate barrier units comprises at least two tubular steel bollard members (15) fixed to the plate part at their bases via a collar (15B) by welding (or other fixing methods, e.g. cement) so as to be upstanding generally in the perpendicular direction from the flat surface of the plate part of respective foot member facing uppermost in use. In other embodiments the bollards may be inclined to the flat upper surface of the foot member to which they are fixed. This may be to take account of inclined ground surfaces such that when the foot member is laid upon it in use, the bollards of that foot member are substantially vertical in orientation. There may be other reasons to incline the bollards relative to their foot member according to design preferences.

Each of four flexible coupling lines (202,203,204,205) separately comprises a length of steel cable secured at both of its terminal ends to a respective one of two anchorage assemblies, in the form of anchorage posts. Each coupling line extends from a first one of the two anchor assemblies and travels away from that anchor assembly by passing successively along one of the two long, peripheral, rectangle edges of the plate parts of each successive foot member of the four barrier units of the barrier assembly before reaching the short, peripheral, rectangle edge of the plate part (4,7) of the foot member of the other terminal barrier unit, that being the edge which is furthest from the anchorage post to which the coupling line is anchored, and which defines a terminal end of the barrier. The given coupling line then extends from other terminal barrier unit and back towards the second anchorage post to which it is anchored.

Thus, the terminal ends of each one of the four coupling lines are secured to a respective one of the two anchorage posts (200,201) at the ends of the barrier. The result is that each coupling line originates from an anchorage post and passes to each foot member of the barrier assembly. In this way, each of the coupling lines passes from each one of the separate foot members of the barrier units, to each one of the other separate foot members of the other barrier units. The result is that each separate foot member is coupled by the coupling lines, separately, to each one of the other foot members of the barrier.

The foot member of each of the barrier units extends in a direction transverse to the two or more tubular bollards fixed to it, from a proximal edge of the foot member which is closest to the bollards and extends in front of each of them, to a distal edge which is parallel to the proximal edge but which is further from the bollards than is the proximal edge. The proximal and distal edges are parallel and are defined by the long, peripheral, rectangle edges of the plate of a foot member. The bollards of a given barrier unit are located between the proximal and distal edges, in a linear array parallel to, and uniformly offset from, each of the proximal and distal edges. The bollard array is closest to the proximal edge. The proximal edge of the plate part of a given barrier unit is positioned in register with the proximal edge of the plate part of each neighbouring barrier unit. The result is that the distal edge of the plate part, and the bollards, of a given barrier unit is also positioned in register with the distal edge of the plate part, and the bollards, of each neighbouring barrier unit.

Each foot member includes a proximal guide conduit (19) and a distal guide conduit (20) each comprising a linear elongate box-section tube, having a pair of opposing parallel, upper and lower, walls separated by a pair of parallel side walls joining them. These four conduit walls define a square-shaped cross-sectional shape uniformly along the length of the guide conduit. One of the side walls is joined, e.g. by welding, along its outer length to substantially the whole length of a long, peripheral, rectangle edge of the plate part of the foot member of a barrier unit. This defines the guide conduit as an elongate duct or tube open only at opposite ends of the conduit and dimensioned to admit two coupling lines along and through it. The conduits may be formed from steel or other metal. Each of the long, peripheral, rectangle edges of the plate part of each of the barrier units possesses such a guide conduit.

The proximal guide conduit (19) extends along the proximal edge of the plate part of each of the foot members and retains the coupling lines in register with the proximal edge as they pass through the respective guide conduit. Similarly, a distal guide conduit (20) extends along the distal edge of the plate part of each of the foot members and retains each of the two coupling lines which pass through it in register with the distal edge.

Figure 2:
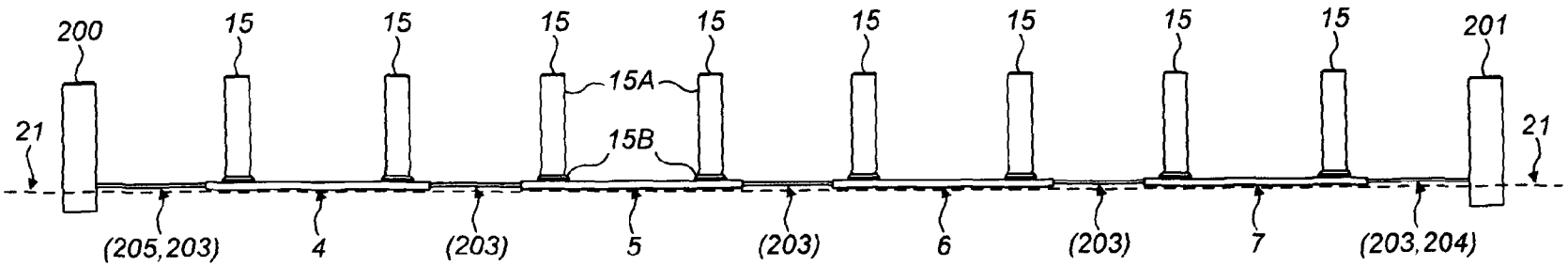
FIG. 2 illustrates a front view of the vehicle impact barrier illustrated in FIG. 1.
Figure 3:
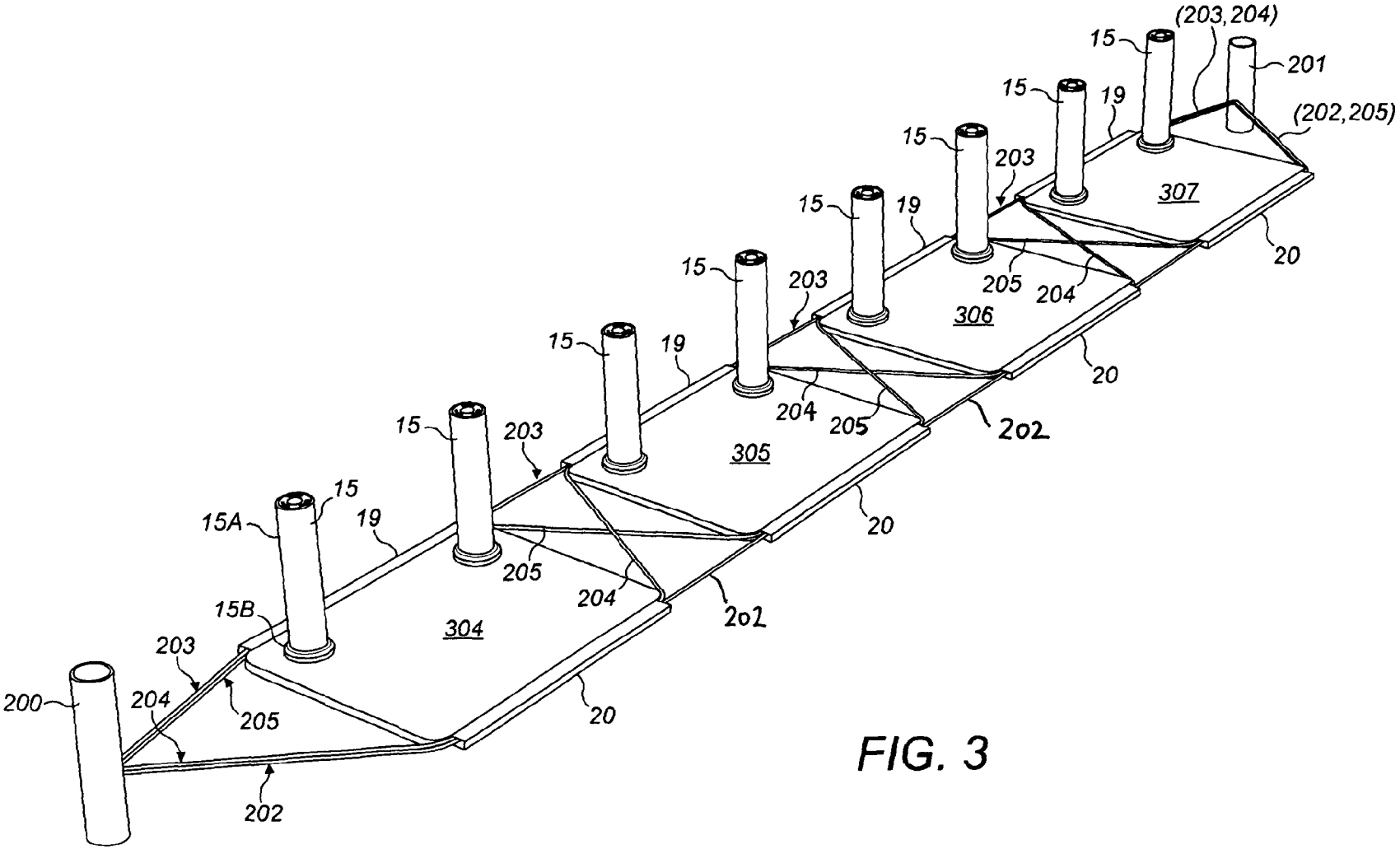
FIG. 3 illustrates a perspective view of the vehicle impact barrier illustrated in FIGS. 1 and 2.

FIGS. 1, 2 and 3 show a plan view, front view and perspective view of an embodiment of the invention.

The barrier comprises a first, second, third and fourth barrier units (304 to 307) and two terminal anchorage posts (200, 201) to which the terminal ends of each of four coupling lines (202, 203, 204, 205) are attached. The anchorage posts comprise ground-penetrating posts (200, 201) which are each fixed to (e.g. firmly embedded in) and upstanding from the ground or floor surface (21) upon which the barrier resides, adjacent to opposite terminal ends of the barrier.

A first coupling line (202) of the barrier of FIG. 1 passes from a first one of two anchor assemblies (200) and passes through a distal guide conduit (20) along the distal edge of the plate part of a first barrier unit (304) of the barrier adjacent thereto. The coupling line exits the distal guide conduit at the space between the first barrier unit and the second barrier unit (305), and passes from the distal guide conduit of the first barrier unit, directly across that space before entering the distal guide conduit (20) of a second barrier unit (305). The coupling line (202) then passes through the distal guide conduit of the second barrier unit along the distal edge of the plate part thereof, and exits the distal guide conduit (20) at the space between the second barrier unit and the third barrier unit (306). The coupling line then passes from the distal guide conduit of the second barrier unit, directly across that space before entering the distal guide conduit of the third barrier unit (306). The coupling line (202) then passes through the distal guide conduit (20) of the third barrier unit (306) along the distal edge of the plate part thereof, and exits the distal guide conduit (20) at the space between the third barrier unit and the fourth barrier unit (307). The coupling line then passes from the distal guide conduit of the third barrier unit, directly across that space before entering the distal guide conduit of the fourth barrier unit (307). It extends along the length of that distal guide conduit and exits the conduit to extent to the second and post 201 to which it is fixed and at which it terminates.

A second coupling line (203) of the barrier of FIG. 1 passes from a first one of two anchor posts (200) and passes through a proximal guide conduit (19) along the proximal edge of the plate part of a first barrier unit (304) of the barrier adjacent thereto. The coupling line exits the proximal guide conduit at the space between the first barrier unit and the second barrier unit (305), and passes from the proximal guide conduit of the first barrier unit, directly across that space before entering the proximal guide conduit (19) of a second barrier unit (305). The coupling line (203) then passes through the proximal guide conduit of the second barrier unit along the proximal edge of the plate part thereof, and exits the proximal guide conduit (19) at the space between the second barrier unit and the third barrier unit (306). The coupling line then passes from the proximal guide conduit of the second barrier unit, directly across that space before entering the proximal guide conduit of the third barrier unit (306). The coupling line (203) then passes through the proximal guide conduit (19) of the third barrier unit (306) along the proximal edge of the plate part thereof, and exits the proximal guide conduit (19) at the space between the third barrier unit and the fourth barrier unit (307). The coupling line then passes from the proximal guide conduit of the third barrier unit, directly across that space before entering the proximal guide conduit of the fourth barrier unit (307). It extends along the length of that proximal guide conduit and exits the conduit to extent to the second and post 201 to which it is fixed and at which it terminates.

A third coupling line (204) of the barrier of FIG. 1 passes from a first one of two anchor assemblies (200) and passes through a distal guide conduit (20) along the distal edge of the plate part of a first barrier unit (304) of the barrier adjacent thereto. The coupling line exits the distal guide conduit at the space between the first barrier unit and the second barrier unit (305), and passes from the distal guide conduit of the first barrier unit, diagonally across that space before entering the proximal guide conduit (19) of a second barrier unit (305). The coupling line (204) then passes through the proximal guide conduit of the second barrier unit along the proximal edge of the plate part thereof, and exits the proximal guide conduit (20) at the space between the second barrier unit and the third barrier unit (306). The coupling line then passes from the proximal guide conduit of the second barrier unit, diagonally across that space before entering the distal guide conduit of the third barrier unit (306). The coupling line (204) then passes through the distal guide conduit (20) of the third barrier unit (306) along the distal edge of the plate part thereof, and exits the distal guide conduit (20) at the space between the third barrier unit and the fourth barrier unit (307). The coupling line then passes from the distal guide conduit of the third barrier unit, diagonally across that space before entering the proximal guide conduit of the fourth barrier unit (307). It extends along the length of that proximal guide conduit and exits the conduit to extent to the second and post 201 to which it is fixed and at which it terminates.

A fourth coupling line (205) of the barrier of FIG. 1 passes from a first one of two anchor posts (200) and passes through a proximal guide conduit (19) along the proximal edge of the plate part of a first barrier unit (304) of the barrier adjacent thereto. The coupling line exits the proximal guide conduit at the space between the first barrier unit and the second barrier unit (305), and passes from the proximal guide conduit of the first barrier unit, diagonally across that space before entering the distal guide conduit (20) of a second barrier unit (305). The coupling line (205) then passes through the distal guide conduit of the second barrier unit along the distal edge of the plate part thereof, and exits the distal guide conduit (20) at the space between the second barrier unit and the third barrier unit (306). The coupling line then passes from the distal guide conduit of the second barrier unit, diagonally across that space before entering the proximal guide conduit of the third barrier unit (306). The coupling line (205) then passes through the proximal guide conduit (19) of the third barrier unit (306) along the proximal edge of the plate part thereof, and exits the proximal guide conduit (19) at the space between the third barrier unit and the fourth barrier unit (307). The coupling line then passes from the proximal guide conduit of the third barrier unit, diagonally across that space before entering the distal guide conduit of the fourth barrier unit (307). It extends along the length of that distal guide conduit and exits the conduit to extent to the second and post 201 to which it is fixed and at which it terminates.

In an alternative, the fourth coupling line may be omitted. In an alternative, the second sand third coupling line may be omitted instead or as well.

Figure 4:
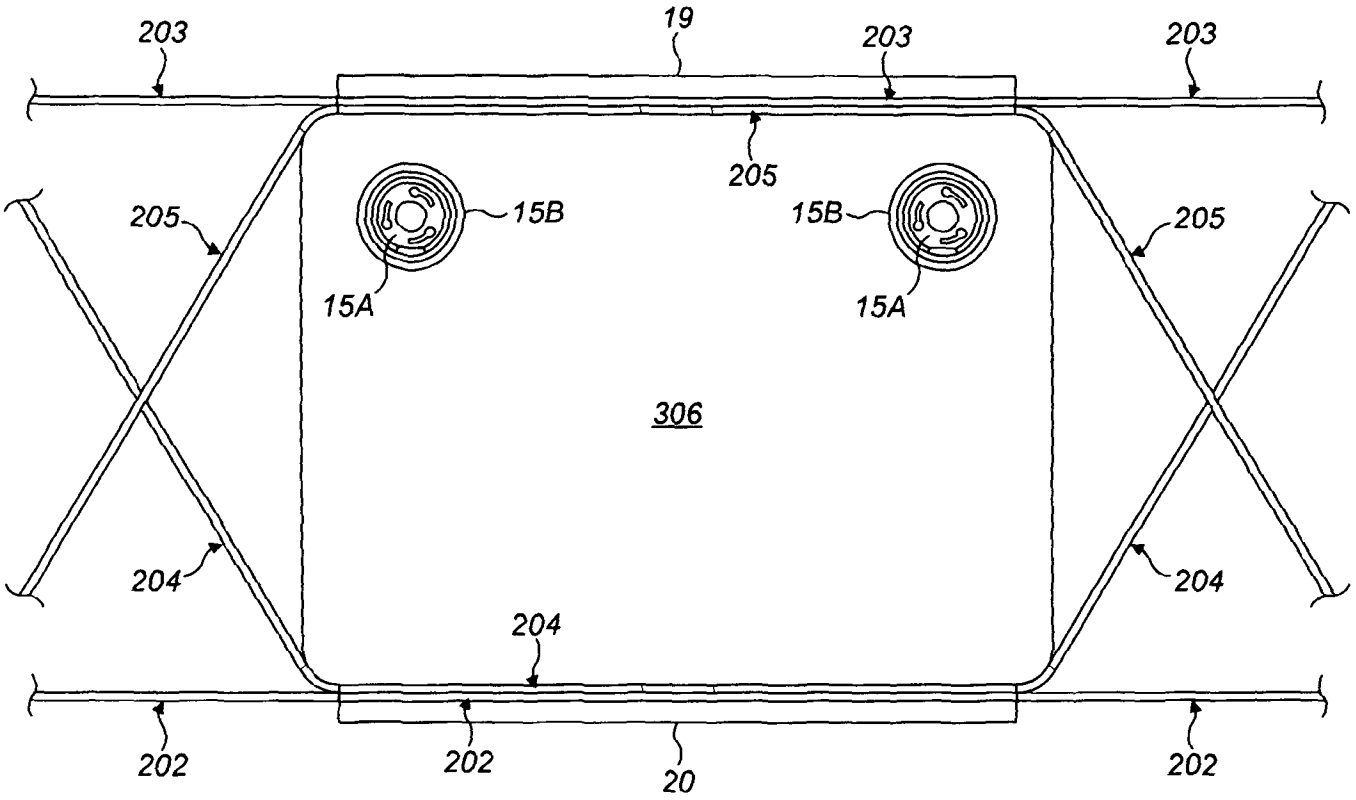
FIG. 4 illustrates in plan view a barrier unit of the vehicle impact barrier illustrated in FIGS. 1 to 3 in which conduit members of the barrier unit are shown schematically in semi-transparent form in order to illustrate the coupling cables passing into them and guided by them.
Figure 5:
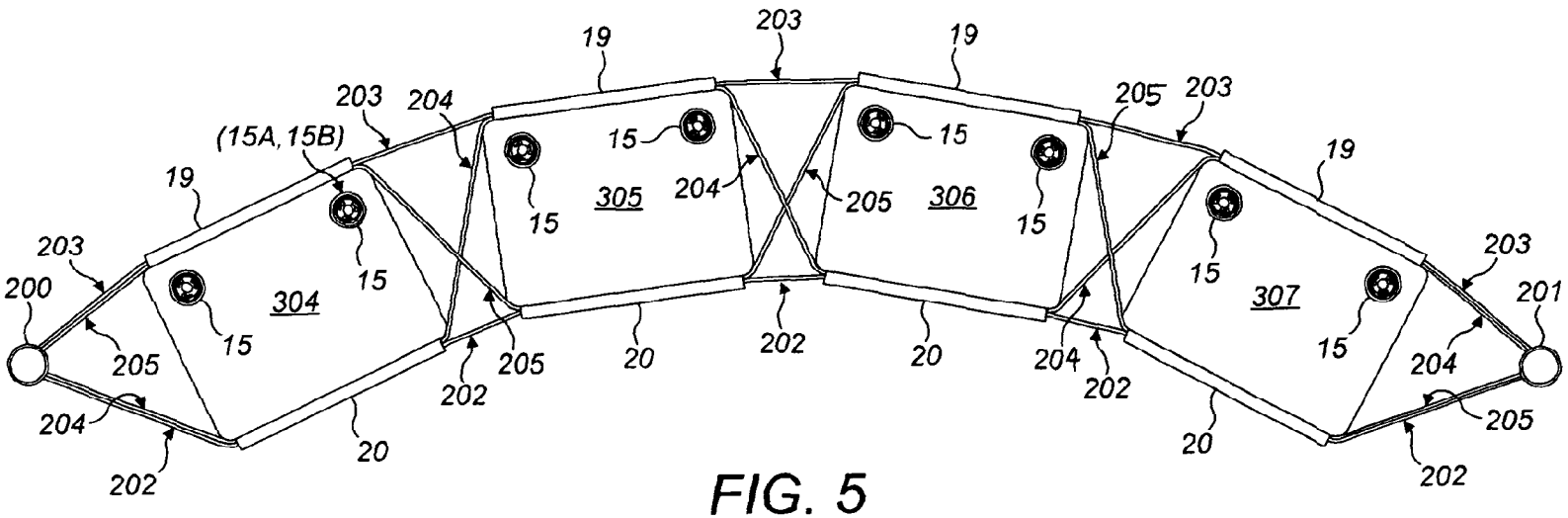
FIG. 5 shows a plan view of the vehicle impact barrier illustrated in FIG. 1 arrayed in a convex arrangement.
Figure 6:
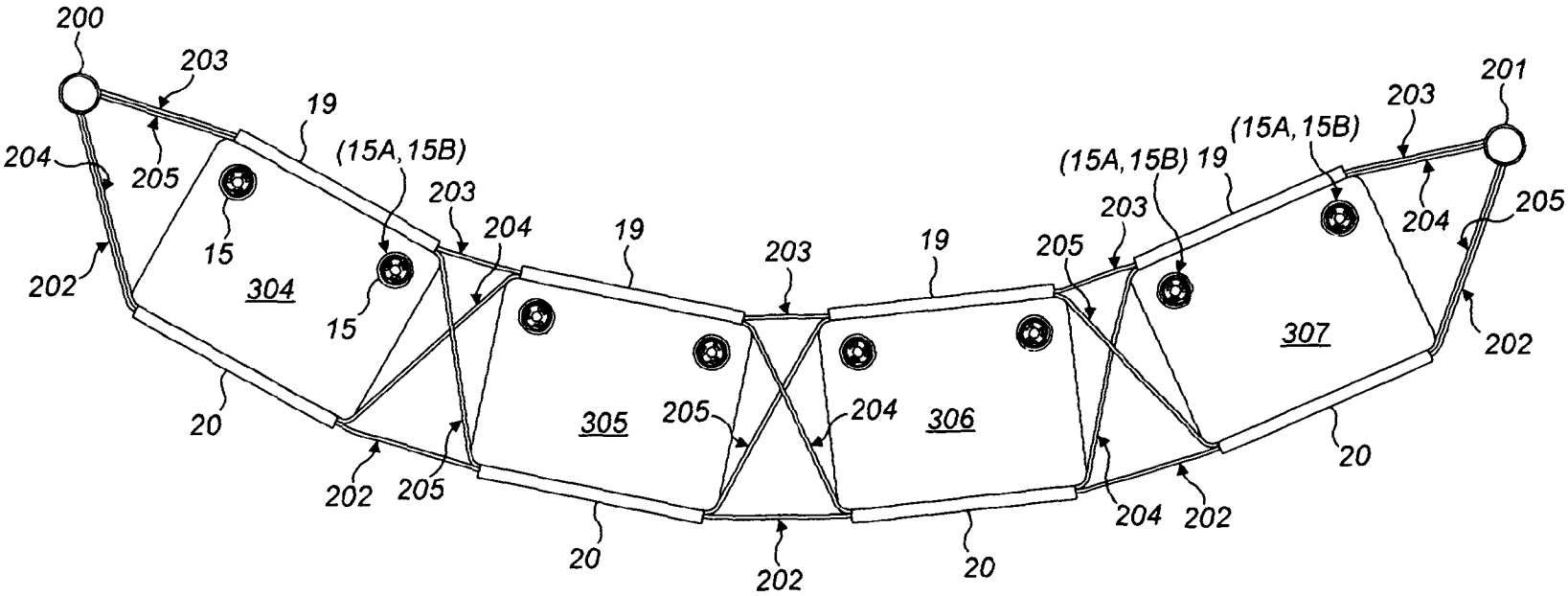
FIG. 6 illustrates a plan view of the vehicle impact barrier of FIG. 1 arrayed in a concave configuration.

FIG. 4 shows a plan view of a part of the barrier of FIGS. 1 to 3 comprising the third barrier unit (306). This view shows the path of the first, second, third and fourth coupling lines (202, 203, 204, 205) in more detail. FIG. 5 shows in plan view of the vehicle impact barrier illustrated in FIGS. 1 to 3 in which the array of four barrier units defining the barrier is convexly curved. FIG. 6 illustrates a plan view of the vehicle impact barrier illustrated in FIG. 5 arrayed in a concave orientation. These figures illustrate the variability with which the barrier array may be positioned/shaped, this being afforded by the sliding interface between the barrier units and the coupling lines via which they are all coupled.

The invention in any of the embodiments described above, or otherwise, may comprise only a coupling line (or lines) which passes along the distal edges and guide conduits of the barrier units of the barrier without passing along a proximal edge. The invention in any of the embodiments described above, or otherwise, may comprise only coupling line(s) which each pass alternately along the distal edges and proximal edges, through successive distal and proximal guide conduits of the barrier units of the barrier, collectively passing along each such edge of the barrier units of the barrier following a serpentine route. The invention in any of the embodiments described above, or otherwise, may comprise a coupling line (or lines) which passes along the distal edges and guide conduits of the barrier units of the barrier without passing along a proximal edge, together with a coupling line(s) which passes alternately along the distal edges and proximal edges, through successive distal and proximal guide conduits of the barrier units of the barrier, collectively passing along each such edge of the barrier units of the barrier by following a serpentine route. The invention in any of the embodiments described above, or otherwise, may omit any coupling line which passes along a proximal edge and proximal guide conduit of the barrier units of the barrier.

The linear route travelled by the first coupling line along the distal edges of the barrier units serves to restrain movement of the barrier units in the direction towards the distal edges. The energy of impact is dissipated by this—such a movement being transferred along the coupling line towards other barrier units. The serpentine route travelled by the third and fourth coupling lines along the array of barrier units of the barrier serves to transfer a rotation/twisting movement of one barrier unit to a neighbouring barrier unit, which is urged by the first coupling line to rotate on the opposite sense. In particular, a corner of a foot part at a distal edge of the plate part of a barrier unit is coupled by a coupling line to a diagonally opposite corner of a foot part at a proximal edge of the plate part of a neighbouring barrier unit. A twisting movement of a barrier unit to move the distal corner in a direction away from the diagonally opposed proximal corner causes a coupling line to pull the proximal corner generally towards the displaced distal corner. This dissipates the impact energies along the barrier array and transforms linear vehicular motion/energy into rotational energy along the separate barrier units of the vehicle impact barrier (1). Furthermore, the second coupling line passing along proximal edges of barrier units assists in impeding the upward pivoting/tippling of a proximal edge when the bollards of that barrier unit are impacted. This is because, the impacted barrier unit is urged back down towards the ground surface by the weight of the rest of the barrier units to which it is coupled at their respective proximal edges by the second coupling line.

Tautness in the coupling lines maximises the effectiveness of these coupling interactions. Transverse deviations in the geometry arrangement of the array of barrier units in the barrier in its quiescent state, with coupling lines taut, tends to pull on one or more coupling lines which thereby resist such deviation, as does the inertial mass of the barrier units and their frictional interface with the local ground surface.

The bollards of the four barrier units collectively define the front of the barrier to be positioned, in use, towards the direction from which impacting vehicles are expected. The distal edges of the four barrier units collectively define the back of the barrier to be positioned, in use, away from the direction from which impacting vehicles are expected. When impact occurs at the front of the barrier, the impacted barrier unit(s) receive an impact force along their vertical length and predominantly concentrated around the upper end of the impacted bollard(s). This impact force urges the impacted bollard(s) to pivot about their base, which is fixed to the foot part of the barrier unit(s) in question. In turn, the respective foot part is urged to pivot upwardly about its distal edge which engages the ground or floor surface upon which the barrier is arrayed. This serves to concentrate impact forces at the distal edge which tends to dig in to, or gouge, the ground or floor surface thereby greatly increasing resistance to movement of the barrier unit.

By coupling together neighbouring barrier units by passing the first coupling line (17) along the distal edges of each of the barrier units in succession, a fulcrum is provided against which a foot member may urge and pivot, at least temporarily during an impact event, to assist or induce this pivoting movement about the distal edges in response to impact forces at the proximal edges of a barrier unit. The fulcrum effect of the first coupling line is to "trip-up" the impacted barrier unit at its distal edge.

Pins, bolts or other ground-penetrating members (not shown) may be arrayed along the distal edges and fixedly entered into the ground/floor surface there to provide an additional fulcrum point against which a foot member may urge and pivot, at least temporarily during an impact event, to assist or induce this pivoting movement about the distal edges in response to impact forces at the proximal edges of a barrier unit. The ground-penetrating members may be arrayed adjacent to the distal edge of a barrier member without passing through the plate part of the barrier member, thereby simply providing a fixed obstacle to sliding movement of the barrier members over the location of the ground-penetrating member. Alternatively, the ground-penetrating members may be arrayed adjacent to the distal edge of a barrier member by passing through apertures (not shown) formed through the plate part of the barrier members.

Each one of two coupling lines in maintained substantially taut. This is achieved by selecting an appropriate length of coupling line according to the separations between, and dimensions of the successive foot members of the barrier array. Each flexible coupling line is fixed to an anchorage post only at the terminal ends of the coupling line such that all sections of a coupling line between its terminal ends is able to slidingly interface with those surfaces of the foot members with which it makes contact. This sliding interface permits movement between the taut coupling line and the foot members coupled by it. The tautness of the coupling line is maintained by its anchorage to the anchorage posts.

Each coupling line is preferably steel cable or wire rope approximately 30 mm in diameter (e.g. from 26 mm to 35 mm), though other diameters may be used. Chain may be used. This may provide a minimum breaking strength of the coupling line of between about 450 kN and 600 kN. The minimum breaking strength of a coupling line maybe determined as the minimum applying a straight-line pulling force that will break the line when both ends of the line are fixed to prevent their rotation, as will be readily understood by the skilled person. One or each coupling line may comprise a plurality of separate coupling sub-lines acting in together to as one coupling line following a common route within the barrier and anchored to common anchorages, which collectively provide the requirements described above.

Vehicular impact forces to which the barrier may be subjected may commence with a sharp impulse force of about 250 ms duration, or thereabouts, as high impact energies are initially imparted to the barrier from the impacting vehicle. The impacting vehicle may be a lorry/truck weighing about 7.5 tons travelling at about 50 kilometres per hour (about 30 mph), for example. The impulse force generated by the initial impact of such a vehicle will result in a high shock load along the axial length of coupling lines of the barrier as the barrier units within it move (twist/translate) to some degree in response. The ability of the coupling lines to remain integral and functional during this initial impulse period is important not only in maintaining the integrity of the barrier but also in effectively dispersing localised impact energies along the length of the barrier. Each coupling line preferably supports a shock load in the range from about 20 tons to about 40 tons, or more, for this reason.

The shock load supportable by a line may be calculated according to the following formula:

$$P_f = P\left(1 + \sqrt{1 + \left(\frac{2hAE}{Pl}\right)}\right)$$

Where $P_f$ is the shock load applied, without line failure, to a line of length l when the static load P, attached to one end of the line, is dropped through a height h with the other end of the line fixed at a fixture point above the drop point. The line has cross-sectional area A (e.g. metallic area of a wire rope), and a modulus of elasticity E. Upon dropping the static load, stress is applied to the line when it is pulled to its full, unstretched, length by the falling load, and is subsequently stretched by the rapidly applied (shock) load incurred as the falling load P is decelerated by the taut line to the end of which it is attached.

The thickness of the steel plate of the plate part of the foot member of each barrier unit may be between 200 mm and 500 mm, such as about 400 mm (or thereabouts). The length of each short rectangle edges of the steel plate may be between 1 m and 2 m, e.g. about 1.5 m (or thereabouts). The length of each long rectangle edge s of the steel plate may be between 1 m and 6 m, e.g. about 2 m (or thereabouts) for smaller barrier units (e.g. comprising two bollards), e.g. about 5 m (or thereabouts) for larger terminal barrier units (e.g. comprising four bollards). Bollards may be between about 0.5 m and 2 m in length, typically about 1 m or thereabouts.

One, some or each bollard (15) may comprise a tube welded at its base to a respective foot plate of a barrier unit, or may most preferably comprise an upstanding collar member (15B) attached to the base of a bollard tube (15A) by welding, the collar being welded to the respective footplate thereby to indirectly connect the bollard tube to the foot plate. Barrier units may have very substantial inertial mass as a result which renders them difficult to move by impact forces of the type described above, especially the larger terminal barrier units.

Figure 7:
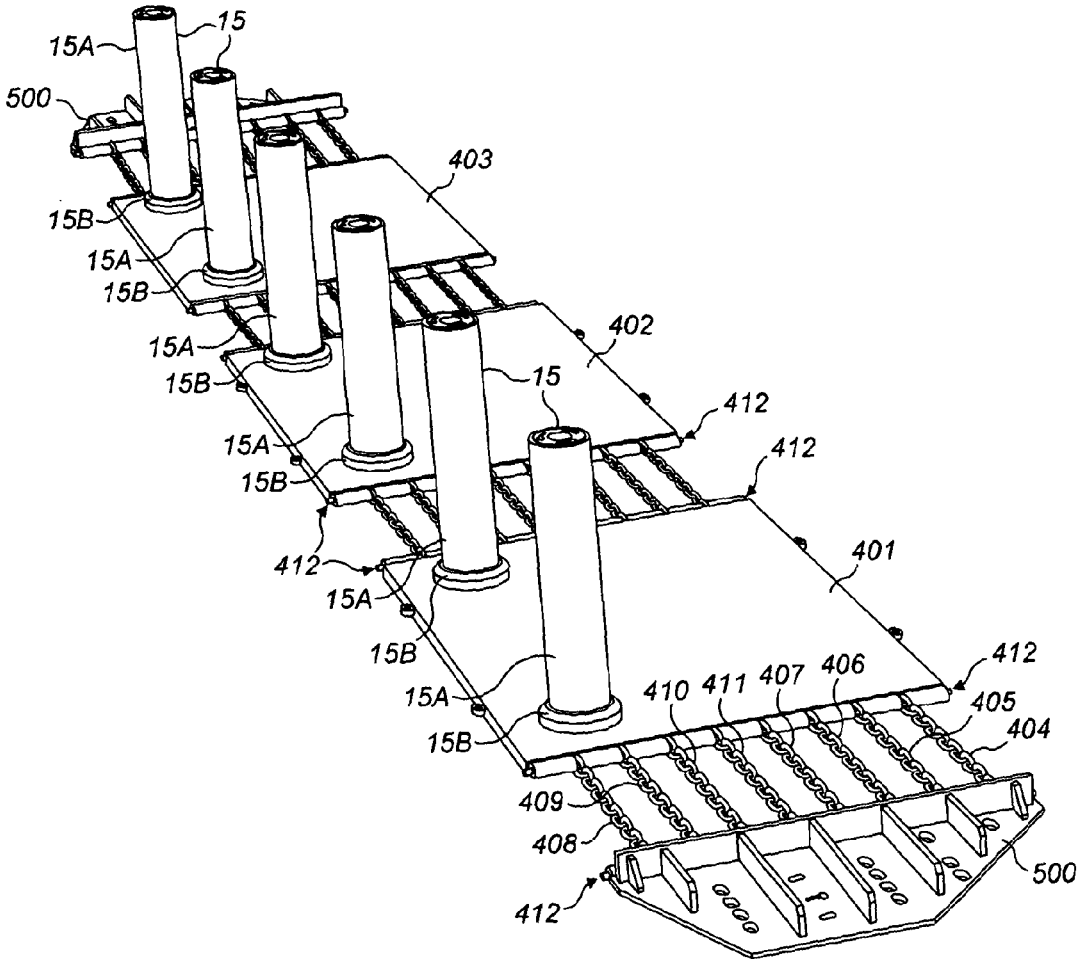
FIG. 7 illustrates a perspective view of the vehicle impact barrier.

Referring to FIG. 7 there is illustrated an alternative embodiment of the present invention in which eight flexible coupling lines extends substantially in parallel between opposing side edges of neighbouring foot members. Each of the coupling lines is a chain. In alternative embodiments fewer coupling lines may be used between opposing edges. One some or all chains may be replaced by an alternative flexible coupling line such as cable or the like, forming a loop or having an eye, link or hook at one or each end to attach to the coupling pin (423).

In particular, three separate barrier units (401, 402, 403) are arranged in a linear array such that each of the two bollards (15) of a given barrier unit are aligned in register with those of each of the other barrier units to form a linear array of evenly-spaced bollards. More such barrier units may be used in the array. Each of the barrier units comprises a rectangular plate part having a proximal rectangle edge near most the bollards carried by the given barrier unit and a parallel distal rectangle edge furthest from those bollards. These proximal and distal rectangle edges are separated by two shorter rectangle edges at opposite sides of a given barrier unit.

Figure 8:
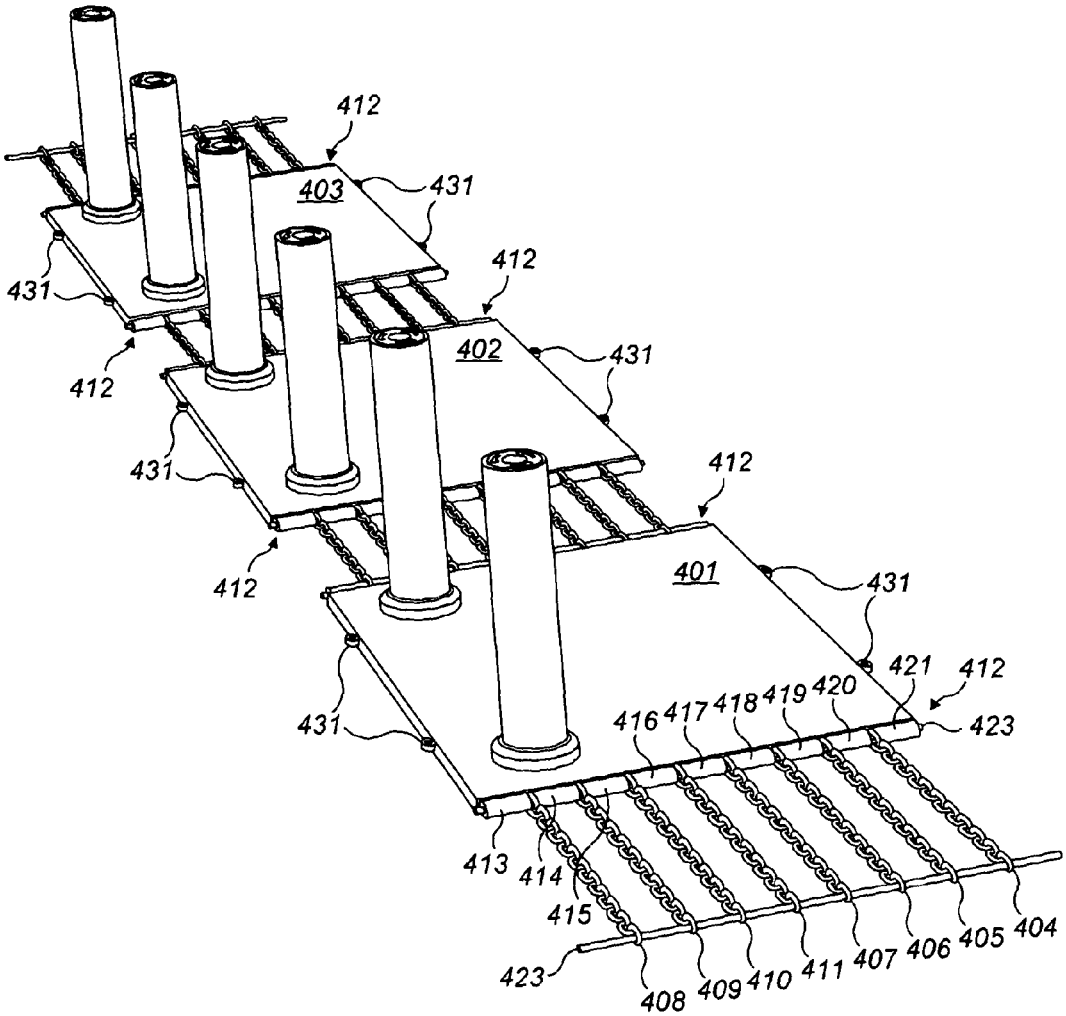
FIG. 8 illustrates a perspective view of the vehicle impact barrier of FIG. 7 with terminal anchor plates removed for clarity of view.

Welded along each of the two side edges of a given barrier unit is an array of evenly spaced and commonly sized/dimensioned steel tube elements (413 to 421; FIG. 8) which each define a through-bore through which passes a common single coupling pin (423). In other embodiments the common single coupling pin may be replaced with a plurality of separate coupling pins each adapted in length to engage the through-bores of at least two successive coupling tubes, but not all coupling tubes, in the array. The plurality of shorter coupling pins may be pushed into the array of successive through-bores one after another. The through-bore of each one of the nine coupling tubes is aligned collinearly and in register with each of the other 9 coupling tubes on the same rectangle edge. The spacing between opposing terminal ends of neighbouring coupling tubes is dimensioned to admit snugly a terminal chain link in a respective one of eight chain lengths (404 to 411). Each of the eight chain lengths comprises a common length of a chain of common type and structure. The common coupling pin (423) which passes through each of the nine coupling tubes in common, also concurrently passes through the loop of the terminal chain link in each one of the eight chain lengths (404 to 411). In this way the common coupling pin (423) passes wholly and completely through each one of the nine coupling tubes and each one of the terminal end links of the eight coupling chains.

A substantially identical array of nine coupling tubes (other than nine may be employed) is similarly fixed and arranged to the opposing and parallel rectangle side edge of a neighbouring bollard assembly, or to the opposing parallel edge of a neighbouring anchor plate (500) adapted to be pinned and bolted or otherwise fixed to a ground surface through holes passing through the surface-engaging plate (500) of the terminal anchor.

For example FIG. 8 illustrates the arrangement shown in FIG. 7 in which the two terminal anchor plates (500) are removed from view to more clearly show the relationship between a common coupling pin and the terminal chain links in the eight coupling chains (404 to 411) concurrently carried by that common coupling pin.

Opposing such linear arrays of coupling tubes, and the intermediate spacings between them are thereby able to be placed in register with one another when the bollards of neighbouring barrier assemblies are also arranged in register in a linear array.

The outer diameter of each coupling tube exceeds the inner diameter of the through-bore of the coupling tube by an amount which substantially matches or exceeds slightly the thickness of the terminal chain link through which the common coupling pin passes. This permits the terminal chain link to pivot or rotate about the common coupling pin in order to avoid stiffness, stress or strain on the coupling pin and to allow the flexible coupling chain lengths to be pulled taut into a generally straight configuration without applying talk to the coupling pin.

The coupling pin (or each of a plurality of shorter pins) is slidingly removable from the array of nine coupling tubes by application of a pulling or pushing force axially along the coupling pin and applied at one of the two exposed terminal ends of the pin in situ.

That is to say, the length of the common coupling pin (or the combined length of multiple shorter pin lengths in a line) exceeds the distance between the extreme terminal ends of the two terminal coupling tubes.

Figure 9A:
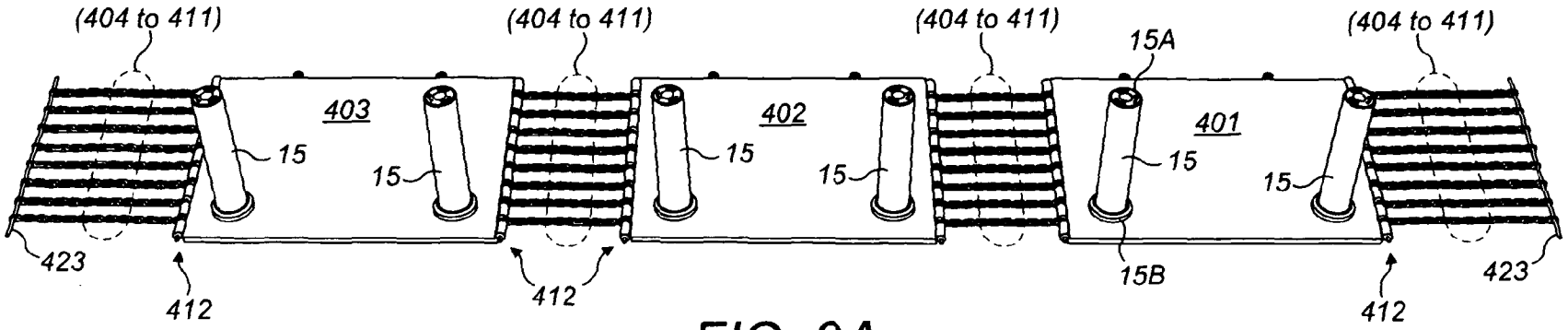
FIG. 9A illustrates a perspective view of the vehicle impact barrier of FIG. 7 with terminal anchor plates removed for clarity of view.
Figure 9B:
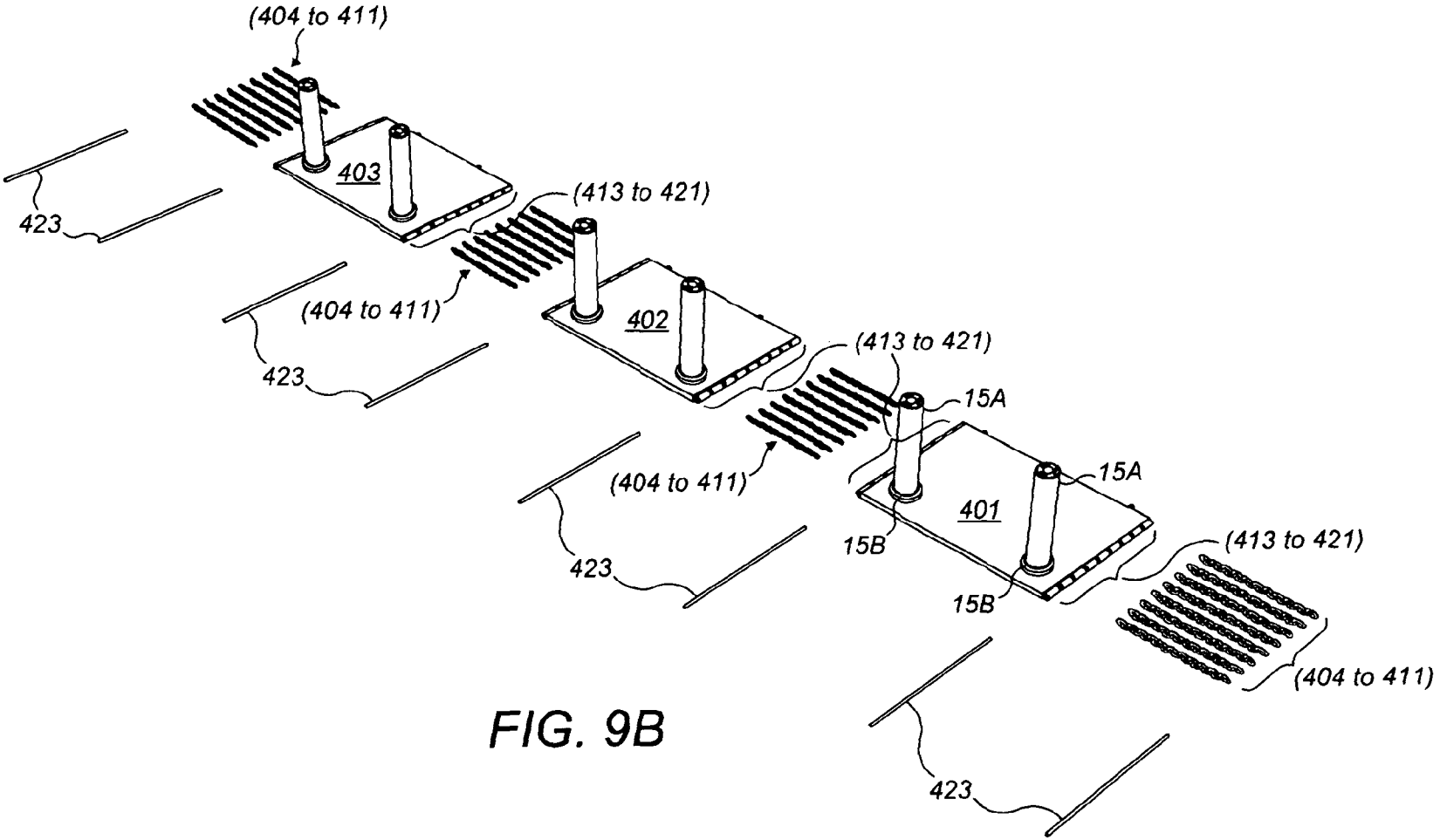
FIG. 9B illustrates a perspective view of the vehicle impact barrier of FIG. 9A with coupling lines detached.

FIG. 9A shows a further perspective view of the arrangement illustrated in FIG. 8. FIG. 9B shows a view of that arrangement in disassembled form. In particular, in FIG. 9B each of the common coupling pins is shown in the removed state and each of the eight coupling chains between neighbouring barrier units, or between a terminal barrier unit and a neighbouring terminal anchor plate (500, not shown) are also in the removed state. In this state, the barrier apparatus comprises a kit of parts ready for assembly into a barrier unit as shown in FIG. 9A, FIG. 8 and subsequently FIG. 7 when also attached to terminal anchor plates (500). Each of the common coupling pins comprises a steel bar of substantially 20 mm diameter. The cross sectional shape of the bar is round/circular so as to provide what is known as a "bright round bar". The tensile strength of the bar is preferably between 950N/mm$^2$ and 1050 N/mm$^2$. For example, a tensile strength of 992N/mm$^2$ is suitable. The yield strength of the bar is preferably between about 850N/mm$^2$ and 950 N/mm$^2$, such as 900N/mm$^2$ for example. The hardness of the material of the bar is preferably of the calibrated hardness value such as HB293, such as would be readily appreciated by the skilled person.

The nominal cross sectional diameter of the material of the coupling chains is about 16 mm but may preferably be between about 10 mm and 20 mm. Preferably the pitch of the links within a chain is about 48 mm, but may preferably be within the range of about 30 mm to 70 mm. The load capacity of each coupling chain is preferably between 5 tons and 15 tons and most preferably 10 tons or thereabouts. The breaking force of each coupling chain is preferably about 400 kN and is most preferably within the range of about 350 kN to 450 kN.

Chains manufactured according to ISO 9001 standards may be used. For example, a chain classified to standard OASTM A973/A973M-01 or EN818-2 may be used. The stress at loading capacity of a chain may be between about 150 $N/mm^2$ and 350 $Nmm^2$, such as 250 $N/mm^2$. The breaking stress of a chain may be between about 600 $N/mm^2$ and 1400 $N/mm^2$. The break elongation minimum of a chain may be between about 10% and 30%, or preferably between about 15% and 25%, such as about 20%.

Figure 10:
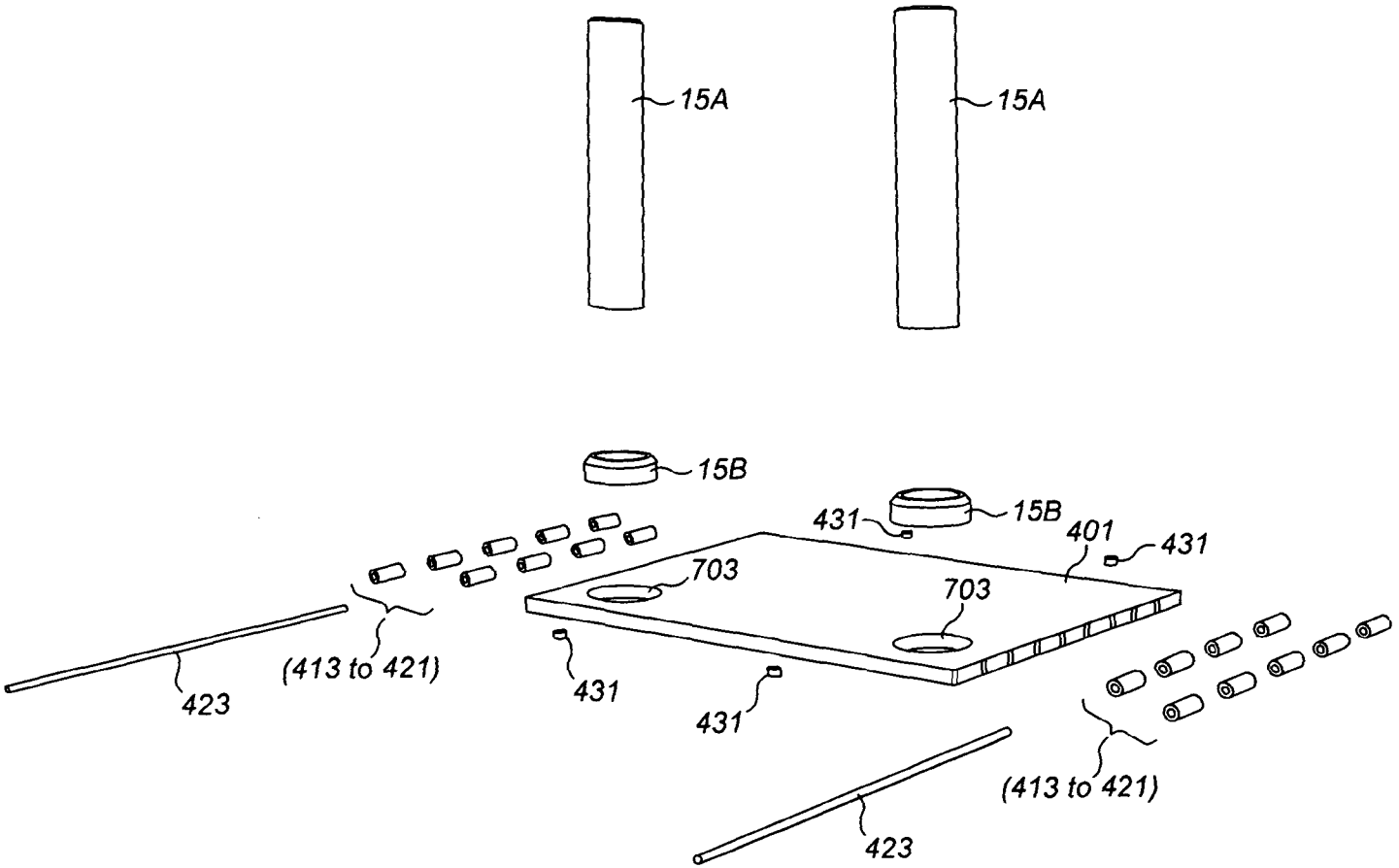
FIG. 10 illustrates an exploded view of a barrier unit of any of FIGS. 7 to 9B.

FIG. 10 illustrates an exploded view of a barrier unit illustrating a foot plate and two groups of nine coupling tubes (413 to 421) and associated common coupling pins (423). Also illustrated are two through-holes (703) each arranged and dimensioned to accept a respective bollard comprising a bollard mounting collar (15A) and a bollard tube (15B). A pair of proximal coupling nuts (431) are welded to the proximal edge of the footplate (see FIG. 17) in spaced-apart positions therealong with the threaded bolt through-openings facing directly upwardly (i.e. perpendicular to the plane of the foot plate). A similar such pair of distal coupling nuts (431) is similarly welded to the distal edge of the foot plate. Alternatively, the coupling nuts may be counter-sunk into the plate of the foot part of the barrier unit The spacing between the two nuts of the proximal pair matches the spacing between the two nuts of the distal pair, with the former pair positioned in register with the latter such that the use of separation between a given nut of the proximal pair and the nearest nut of the distal pair is substantially perpendicular to the rectangular edges to which they are welded. That perpendicular line of separation passes between the two bollards of the barrier unit.

Figure 11:
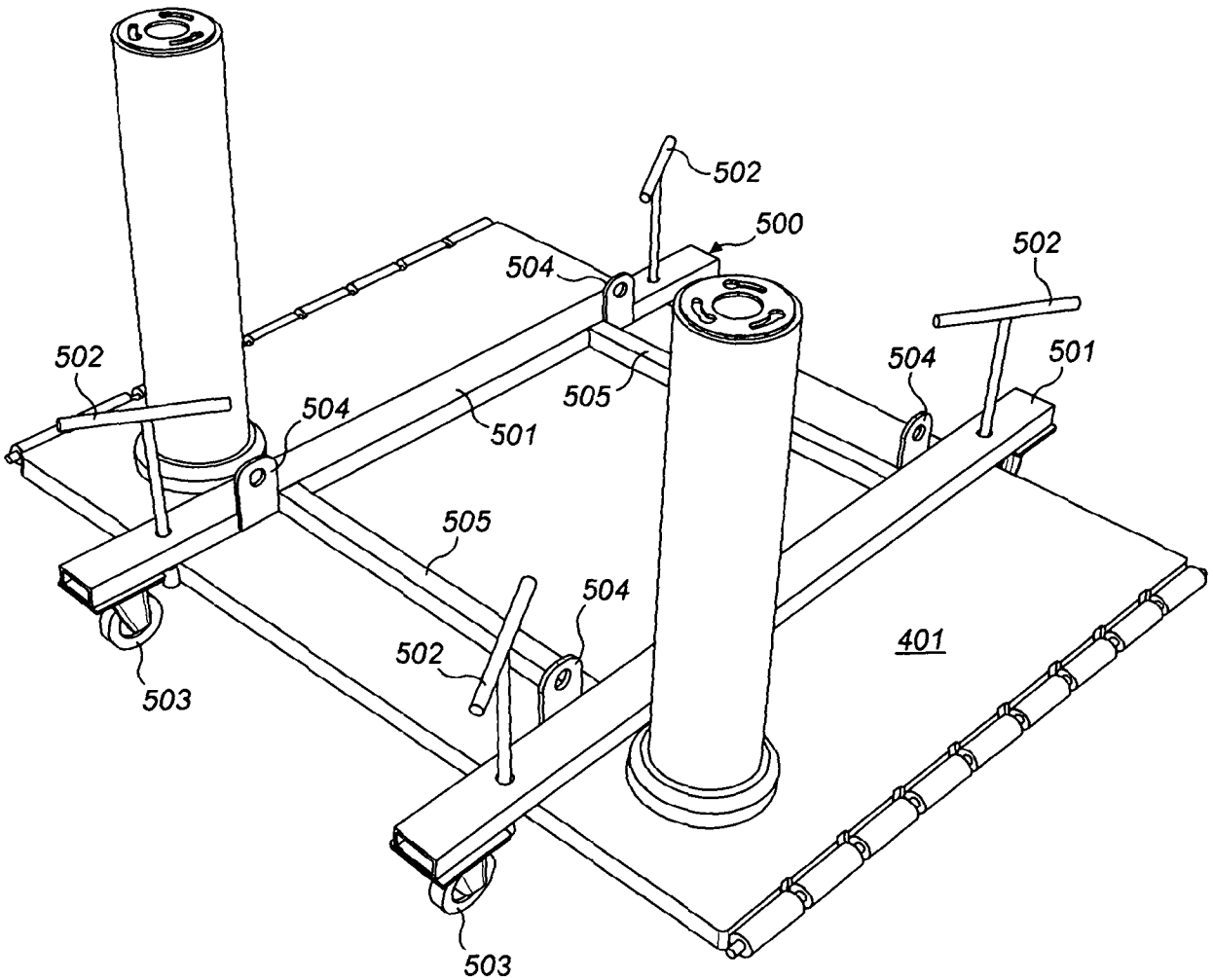
FIG. 11 illustrates a perspective view of the barrier unit of FIG. 10 mounted to a transport carriage.
Figure 12:
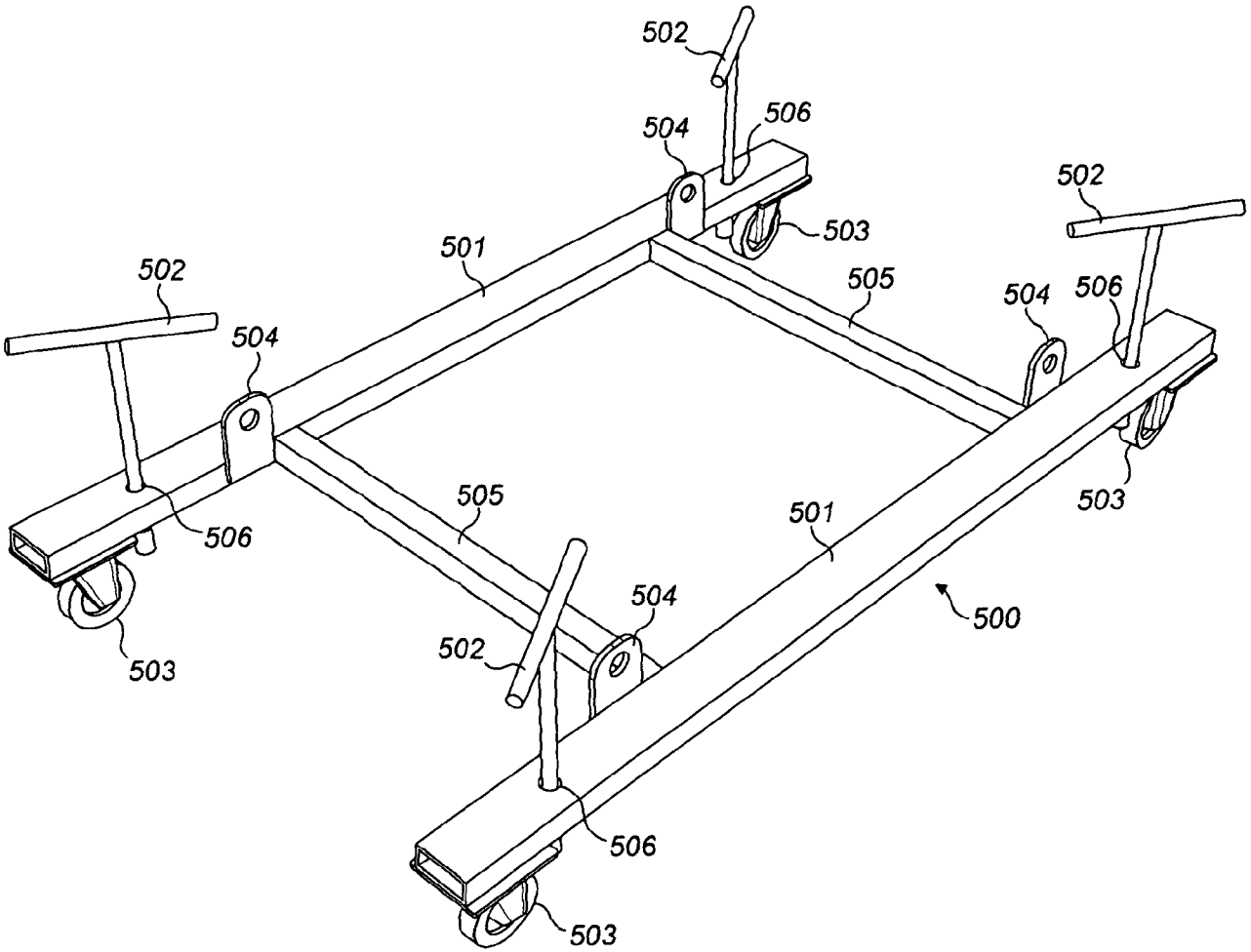
FIG. 12 illustrates a perspective view of the transport carriage of FIG. 11.

FIG. 11 and FIG. 12 illustrate the function of the coupling nuts in conjunction with a transport carriage (500) adapted and arranged for use in lifting a barrier unit and transporting it upon wheels.

The transport carriage comprises a pair of parallel box-section carriage beams (angle-section beams maybe employed alternatively) indicated as items 501. The parallel carriage beams are separated by two spaced transverse beams (505) having a length such that the maximum transverse width of the transport carriage is substantially less than the separation between the opposing external surfaces of the two bollards of the barrier unit (e.g. less than 1.2 meters). Each of the carriage beams (501) has welded to it two lifting tabs (504) positioned adjacent the transverse beams (505) attached thereto. Through-holes pass through each of the lifting tabs and are dimensioned to admit a hook or other support line with which the transport carriage maybe coupled to a lifting mechanism (e.g. a crane, a forklift truck etc) to allow the transport carriage to be lifted together with a barrier assembly attached to it as shall now be described.

Adjacent the terminal ends of each of the two carriage beams (501) of the transport carriage is positioned respective of one of four lifting rods (502) comprising a substantially vertical rod position (502) topped by a transverse section defining a generally "T" handle.

The lowermost terminal end of the lifting rods projects outwardly through the through-openings (506) passing through the upper and lower walls of the box-section carriage beams and terminates with threading adapted to match the internal threading of each one of the four coupling nuts (431) welded to the proximal and distal edges of the foot member (401) illustrated in FIG. 11. The spacing between near most lifting rods (502) upon the transport carriage matches the spacing between each of the pairs of coupling nuts such that each one of the four lifting rods can be placed directly in register with a coupling nut concurrently and in tandem. The lowermost terminal threaded end of each of the four lifting rods may then be threaded into the internal threading of a respective one of the four coupling nuts in order to couple each one of the lifting rods to the foot part (401) of the barrier unit. Optionally, by turning the lifting rods in such a way as to increasingly insert the terminal threaded end of the lifting rod into the coupling nut, the footplate is lifted upwardly as shall now be explained with reference to FIG. 13. However, alternatively, each of the four carriage wheels (503) of the transport carriage may be moveably connected to the carriage beams (501) by a hydraulic or mechanical lifting mechanism (not shown) which may reversibly increase the separation of each carriage wheel, in tandem, from the carriage beams thereby to lift the barrier unit plate part off the ground thereby to suspend it underneath the carriage beams to allow the transport carriage to move upon its wheels to transport the barrier unit.

Figure 13:
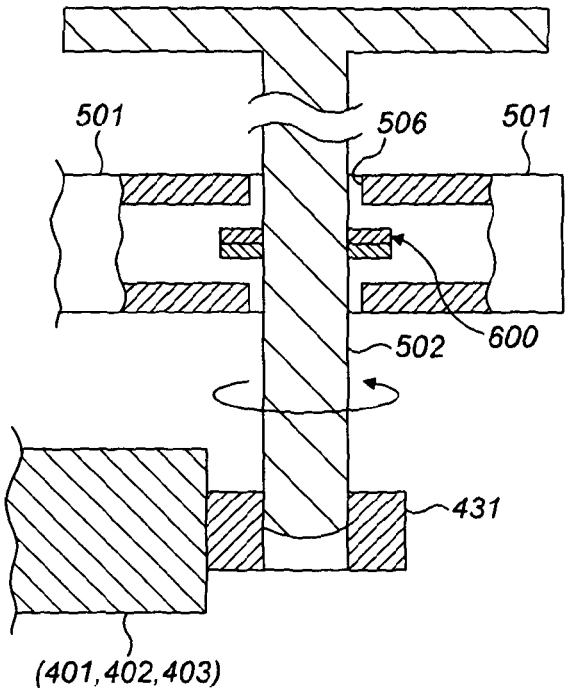
FIG. 13 shows a cross sectional view of parts of the transport carriage and barrier unit of FIG. 11.

FIG. 13 illustrates a cross-sectional view of a part of the transport carriage illustrated in FIGS. 11 and 12 comprising a section of a carriage beam (501) through which passes a lifting rod (502).

The portion of the lifting rod positioned above the internal floor of the box-section carriage beam within the carriage beam, is threaded externally and carries upon it a reciprocally threaded load nut assembly (600) comprising a pair of nuts tightened against each other so as to be substantially firmly positioned upon the shaft of the lifting rod. The terminal end of the lifting rod, and sufficient of the external length of the lifting rod leading up to that terminal end, is externally threaded to permit it to engage with the coupling nut (431) upon the plate part of the barrier unit (401).

The separation between the lowermost surface of the load nut assembly (600) and the terminal threading of the lifting rod exceeds the distance between the uppermost surface of the floor of the box section carriage beam and the threaded opening of the coupling nut (431) welded to the plate part. This separation is determined by the height of the box-section carriage beam above the local ground surface supporting the carriage trolley and the barrier unit. The distance may be adjusted as desired by loosening the tightened pair of nuts of the load nut assembly, repositioning them securing them in their new position by re-tightening them there.

Operation of the lifting rod to lift the barrier unit (401) is as follows. With the load nut assembly separated from the internal floor of the carriage beam, the terminal threading of the lifting rod is inserted into the coupling nut (431) and rotated to engage with the coupling nut. Continued such rotation draws the lifting rod towards the coupling nut and thereby draws the load nut assembly (600) into contact with the upper surface of lower internal floor of the carriage beam (501). Once such contact is made, continued rotation of the lifting rod simply causes the fixed load nut assembly to rotate against the floor of the support bean it abuts without moving axially along the threaded parts of the lifting rod it is fixed to. Consequently, the terminal threading of the lifting rod bears upwardly against the internal threading of the coupling nut to raise the coupling nut along the axis of the lifting rod, and the barrier unit along with it.

When this operation is done in tandem at each of the four lifting rods (502) the whole of the plate part of the barrier unit may be lifted off of the ground and moved by pushing the transport carriage upon its wheels (503) which may be swivel-mounted to their respective support beams (as in a trolley), or by attaching the transport carriage to a lifting device via the four lifting tabs (504).

Figure 14A:
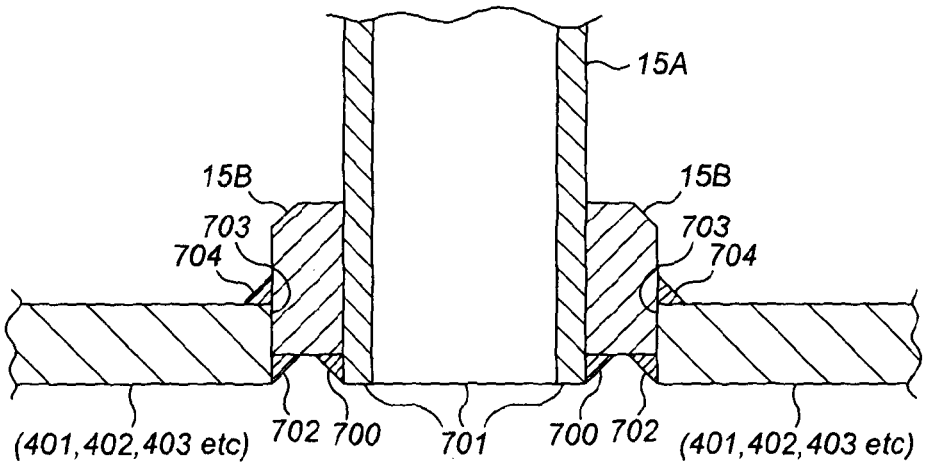
FIGS. 14A to 14C show cross-sectional views of parts of the barrier unit of FIGS. 1 to 11 showing the collar member, the bollard tube and the foot plate thereof.
Figure 14B:
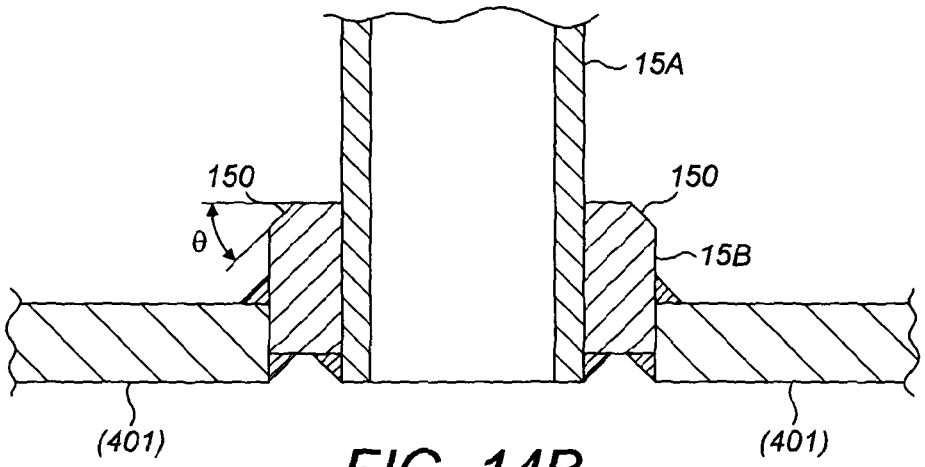
Figure 14C:
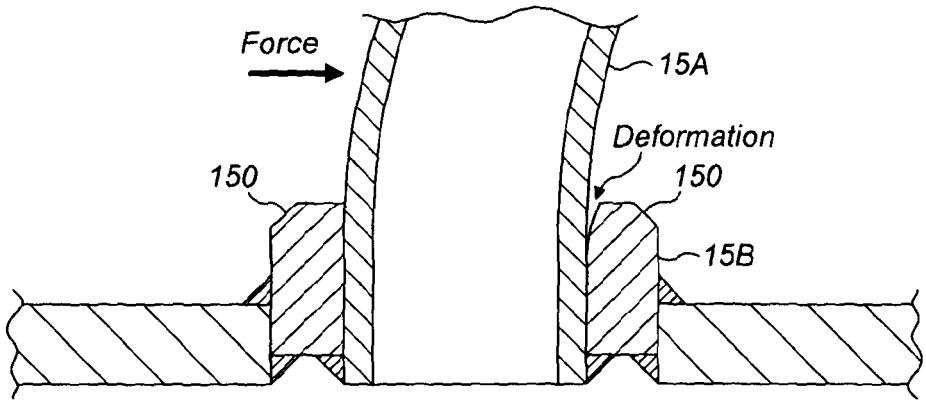

FIGS. 14A to 14C illustrate a cross-sectional view of a plate part of a barrier unit (304 to 307, 401 to 403) including one of the two through-openings (703, FIG. 10) and the end parts of a bollard (15) located within the through-opening.

Each collar member (15B) is attached to the lower portions of a respective bollard tube (15A) near the terminal end thereof nearest the plate part from which both extend. The terminal end of the bollard tube passes fully through the collar member which circumferentially envelops and embraces the curved tubular outer surface parts of the bollard tube located within the collar. A short terminal length (about 20 mm in the axial direction) of the bollard tube projects beyond the base of the collar member within the through-opening. The result is that the final short terminal length of the bollard tube is exposed within the through-opening.

The terminal end surface (700) of the bollard tube is positioned to be flush with the periphery of the through-opening at the underside of the plate part so as not to project from the plate part at the underside. A circular channel is thereby formed between the outer curved tubular surface of the short portion of exposed bollard tube end, and the opposing inner curved surface of the circular through-opening adjacent the surface of the plate part lowermost in use. A continuous first fillet weld (700) is located within this circular channel between the exposed end portion of the bollard and the adjacent base surface of the collar member. This weld fixes the exposed end of the bollard tube to the collar. A second separate continuous circular fillet weld (702) is formed in the circular channel between the base surface of the collar member and the adjacent inner surface of the through-opening (703) of the plate part not covered by the bollard tube. This weld fixes the base surface of the collar member to the inner wall of the through-opening also. Optionally, a third fillet weld (704) may circumscribe the collar member where it is upstanding from the upper surface of the plate part, filling the corner formed thereby with the upper surface to join the collar to the upper surface.

The outer circular diameter of the collar member (15B) matches the inner circular diameter of the through-opening and forms a tight interference fit therewith at substantially all of those external parts of the collar member located opposing the inner wall of the through-opening. The height of the collar member exceeds the thickness of the plate part, by approximately a factor of two and is only partially inserted into the through-opening so as to extend from the through-opening at the same side of the through-opening from which the bollard tube (15A) concurrently extends. As a result, the collar member is upstanding from the surface of the plate part uppermost in use as is the bollard tube which passes through it.

Consequently, lateral forces applied to the bollard during vehicular impact are transmitted to the plate part via the intermediate collar member. The greater surface area of the interface that can be provided between the collar member and the parts of the bollard tube it embraces reduces the pressure at that interface as compared to what would be the case were the collar absent and the bollard tube in direct contact with the through-opening. The bollard is also effectively thicker at the interface with the through-opening by virtue of comprising the bollard tube thickness and the surrounding collar thickness there. This adds to bollard strength where most needed without having to continue that level of thickness along the whole length of the bollard tube, which would render the bollard expensive and heavy. Also, the positioning of the collar member relative to the end of the bollard tube and through-opening wall, to provide a circular channel for receiving welding (700), allows the bollard tube to be welded to the plate part via a minimal portion of its outer tubular surface relatively furthest from the likely point of vehicular impact. It has been found to be advantageous to minimise the application of welds to the outer tubular surface of a bollard tube as they tend to stress the tube and provide points of weakness when the bollard tube is under impact.

The collar member defines an inner bore having a circular diameter dimensioned to match the outer circular diameter of the bollard tube at its base. The outer tubular surface of the bollard at its base end thereby forms an interference fit with the bore of the collar member. The outer circular diameter of the collar member is structured to reduce increasingly towards the head end thereof at parts of the collar member adjacent to the head end, furthest from the through-opening of a foot member. This forms an even tapering of the outer diameter of the collar member. The diameter if the bore of the collar member is uniform along the length of the bore such that the tapering results in a progressive reduction in the thickness of the walls of the bore of the collar member towards its head end.

FIG. 14B shows the collar member (15B) in cross-sectional view in more detail. In the present example, illustrated in FIGS. 14A to 14C, the tapering results in a flat chamfered outer edge of the collar surrounding its head end. Other tapering geometries and forms may be used. The angle (θ) of the taper is between 35 degrees and 50 degrees, e.g. about 45 degrees. The tapering may begin from a position on the outer surface of the collar member between about 25 mm and 35 mm below the head end, and may be such as to reduce the thickness of the tubular wall of the collar member, around its entire circumference, to a thickness of between about 0 mm (zero—i.e. tapered through the entire wall thickness) to about 15 mm, preferably of between about 7 mm to 12 m.

The collar wall thickness (un-tapered parts) may be between about 20 mm and 50 mm, preferably between 30 mm and 40 mm. Preferably, the collar is made from a mild steel. The collar part may preferably be made from a material more deformable, malleable or less hard than the material of the bollard (e.g. harder steel).

The tapering of the collar member towards its head end provides there a region of relatively increased deformability in the collar member. When this region is subject to vehicular impact forces directed transversely to the axis of the bollard tube, and the bore of the collar member containing the bollard tube, it has a purposely increased tendency to deform relative to the un-tapered parts of the collar member, and in so doing has a much greater capacity to absorb impact energies by the act of deforming in response to them. Such impact forces tend to generate a torque upon the bollard tube acting about a fulcrum formed between the base region of the bollard tube and the bore of the collar member embracing it. This tends to be the region circumscribed by the periphery of the through-opening in the foot part of the barrier unit within which the collar and bollard are mounted. Consequently, energy is imparted into the tapered head end of the collar member significantly by this torque action. This energy may be efficiently absorbed and dissipated into the process of deforming the tapered parts of the collar member rather than shearing or significantly compromising the bollard tube at the head end of the collar member. FIG. 14C illustrates this process schematically.

This use of a collar member with one, some or all bollards of a barrier unit may be applied to the invention in any and all embodiments.

Figure 15:
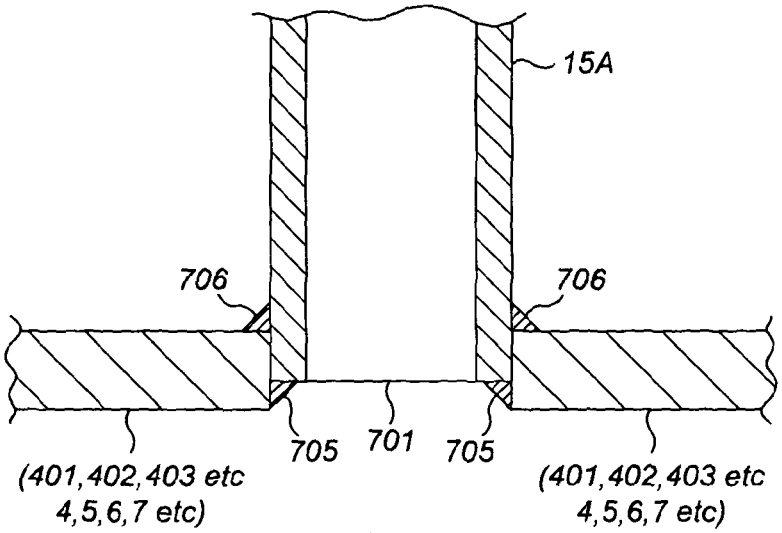
FIG. 15 shows a cross-sectional view of parts of the barrier unit in an alternative embodiment showing the bollard tube welded directly to a foot plate.

FIG. 15 illustrates a cross-sectional view of parts of a barrier unit in which a bollard is fixed directly to a plate part in alternative embodiments of the barrier units illustrated in FIGS. 1 to 15 in which the collar member is dispensed with.

In particular, a bollard comprises a bollard tube (15A) having a base end (701) inserted into a through-opening in a plate part (4,5,6,7 etc or 401, 402, 403 etc). The base end (701) of the bollard tube is recessed from the peripheral edge of the through-opening at the base surface of the footplate so as to define a corner at the junction between the base surface of the bollard tube and the adjacent inner walls of the through-opening. A continuous circular fillet weld (705) joins the bollard to the plate part at this corner. Optionally, a second continuous circular fillet weld (706) may be formed in the corner defined by the junction between the outer curved surface of the bollard tube and the adjacent uppermost surface parts of the plate part defining the periphery of the through-opening in the plate at that uppermost surface. In this way the second fillet weld joins the bollard tube (15A) to the plate part.

Figure 16:
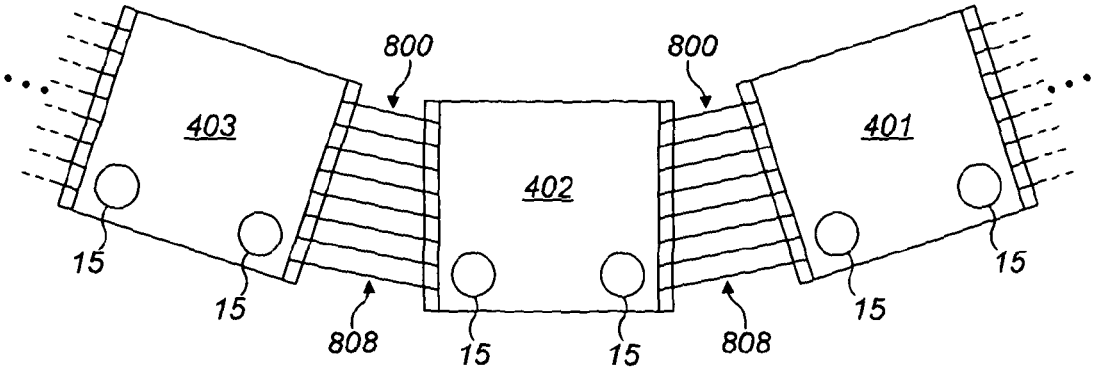
FIG. 16 shows a convex portion of a barrier comprising a three barrier units and intermediate coupling chains of differing lengths.

Referring to FIG. 16, there is schematically illustrated a plan view of three barrier units (401, 402, 403) of a vehicle barrier comprising additional barrier units (not shown) consecutively arranged to define a curved vehicle barrier convex at the front and concave at the rear. The parallel rectangle side edges opposing one another as between successive neighbouring barrier units are not parallel but, rather, are closer to each other at the rear of the vehicle barrier and progressively become further apart towards the front of the barrier. In order to achieve tautness of the flexible coupling lines (800 to 808) between the opposing edges (the coupling lines may preferably be chains as described above, or otherwise) successive of the coupling lines within a given group between two neighbouring barrier units, are of increasing length as considered in a direction starting from the rear of the barrier towards the front of the barrier.

For example, a coupling line (chain) nearest the rear of the barrier (800) is shorter than the coupling line (e.g. chain) located nearest the front of the barrier (808) between the same two barrier units. Indeed, the coupling line nearest the front of the barrier is the longest coupling line of the group of eight and all coupling lines between the shortest and the longest are each a respective of one of six different intermediate lengths each of which corresponds to the distance between the opposing edges of the neighbouring barrier units between which they extend. This length differential permits all of the eight coupling lines between neighbouring barrier units to be substantially taut when the successive barrier units are arranged in an arc.

Figure 17A:
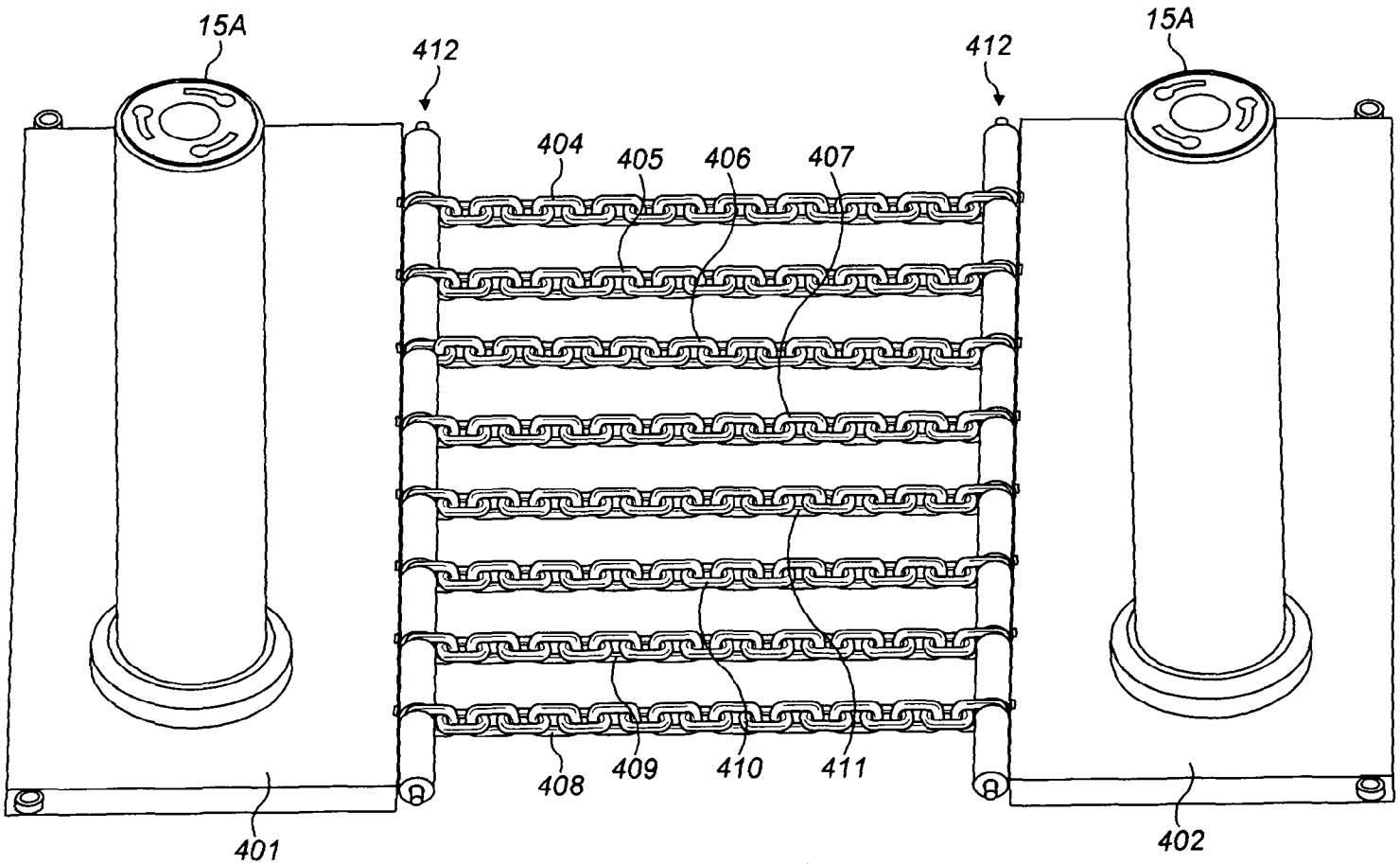
FIG. 17A shows a magnified view the top side of two neighbouring barrier units showing nearmost opposing bollards and adjacent opposing side edges of foot plates with coupling lines extending therebetween.
Figure 17B:
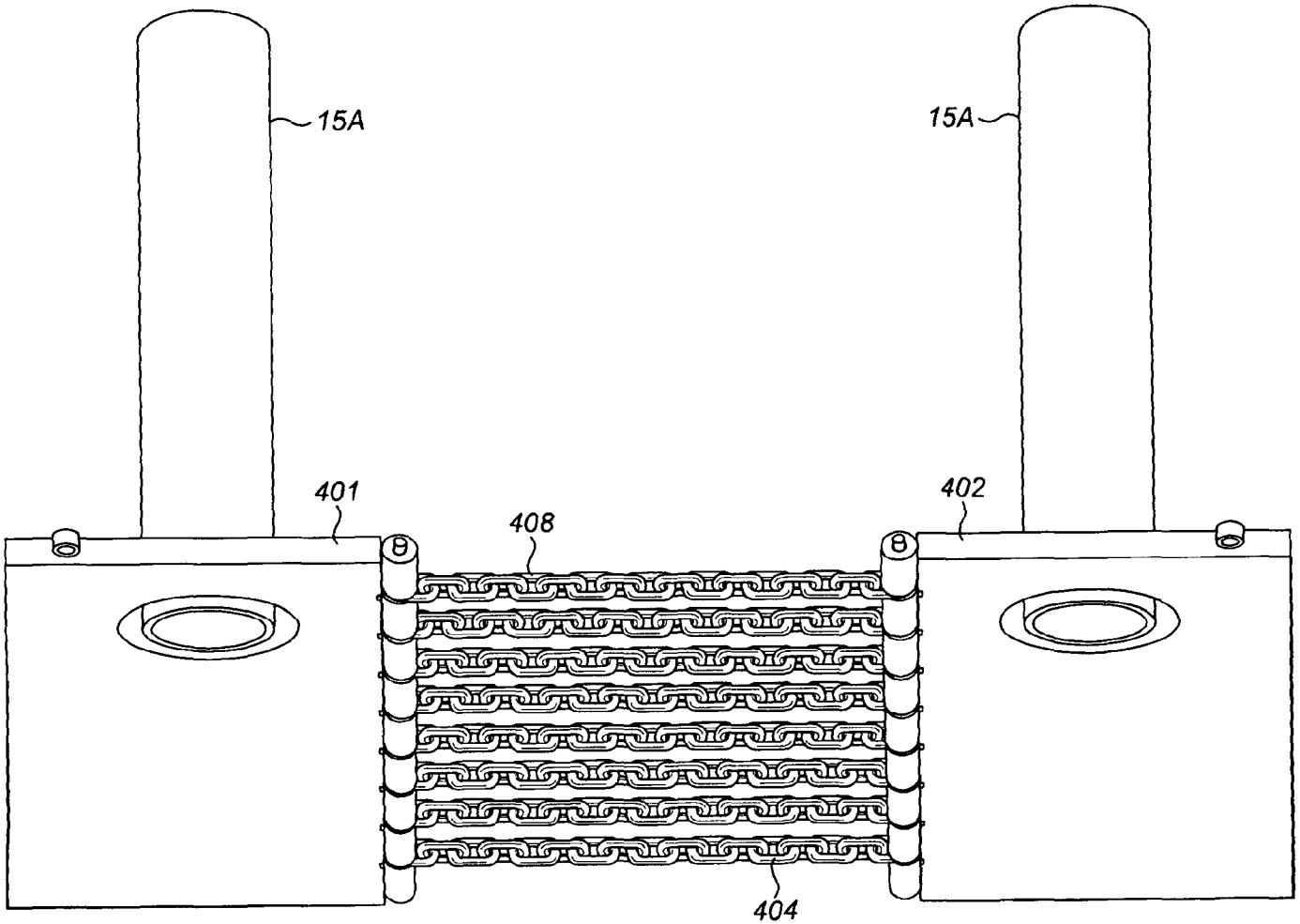
FIG. 17B shows a magnified view of the underside of two neighbouring barrier units showing nearmost opposing bollards and adjacent opposing side edges of foot plates with coupling lines extending therebetween.

This is to be contrasted with the arrangements described above with reference to FIGS. 7 to 9B in which successive of the eight coupling lines (chains) between opposing edges of successive barrier units are substantially all the same length such that the opposing edges are substantially parallel when the coupling lines between them are all taut. FIGS. 17A and 17B illustrate a magnified view of the upper side and under side regions of near most parts of two neighbouring barrier units showing opposing rectangle side edges, parallel taut coupling lines of equal length and opposing near most bollard tubes.

In order to modify the arrangement illustrated in FIGS. 17A and 17B to achieve the arcing arrangement of FIG. 16, a front chain length (408) may be retained, whereas each of the other seven chain lengths (409, 410, 411, 407, 406, 405 and 404) should be shortened by removing a sufficient number of chain links such that the resultant chain length substantially matches the separation between the opposing rectangle side edges of the two neighbouring barrier units between which the respective chain length is intended to extend and be attached to.

FIGS. 18 to 26C show views of shock absorbing insert units adapted for use in further adjusting the length of a section of chain forming a coupling line described above, without requiring the removal of further chain links. The shock absorbing inserts also provide shock absorbing structure for absorbing impact shock forces applied along a coupling line chain in the event of vehicular impact to the barrier units coupled by such chains. The result is to in effect, make a given coupling line more "stretchy" to enable it to better absorb shock without breaking or snapping and, additionally, to effectively increase the breaking force at which a given chain would otherwise break in the absence of such shock-absorbing inserts.

Figure 18:
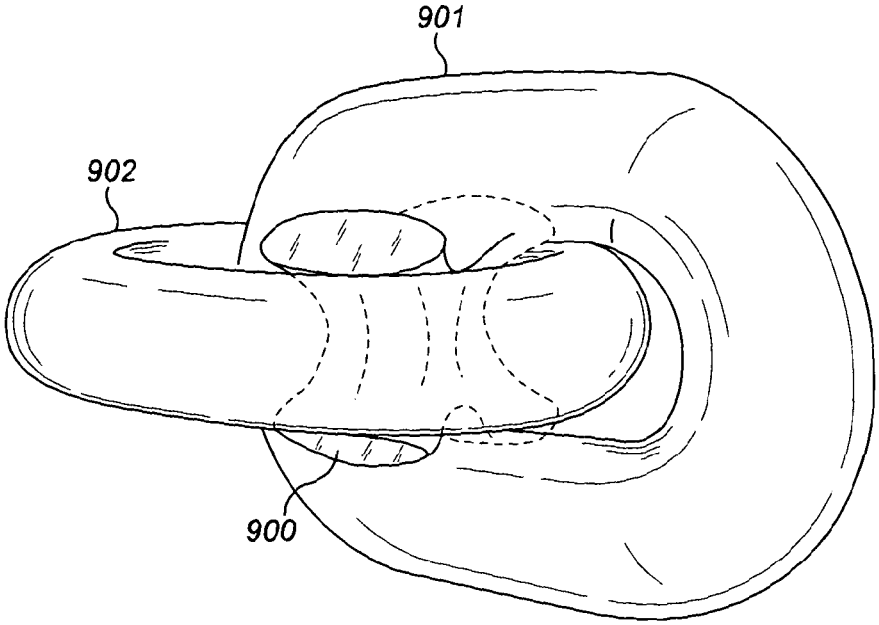
FIG. 18 shows two successive chain links of a chain of the barrier apparatus with a shock absorbing apparatus inserted between opposing bearing surfaces of neighbouring chain links.
Figure 19A:
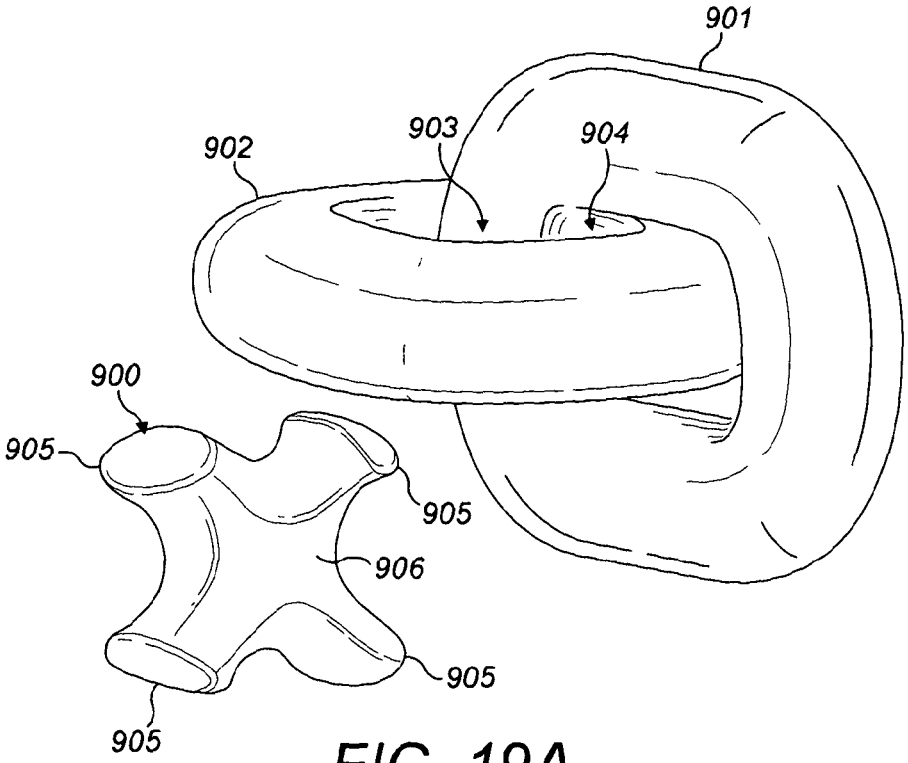
FIGS. 19A and 19B each show the two successive chain links of a chain of the barrier apparatus of FIG. 18 with the shock absorbing apparatus removed.
Figure 19B:
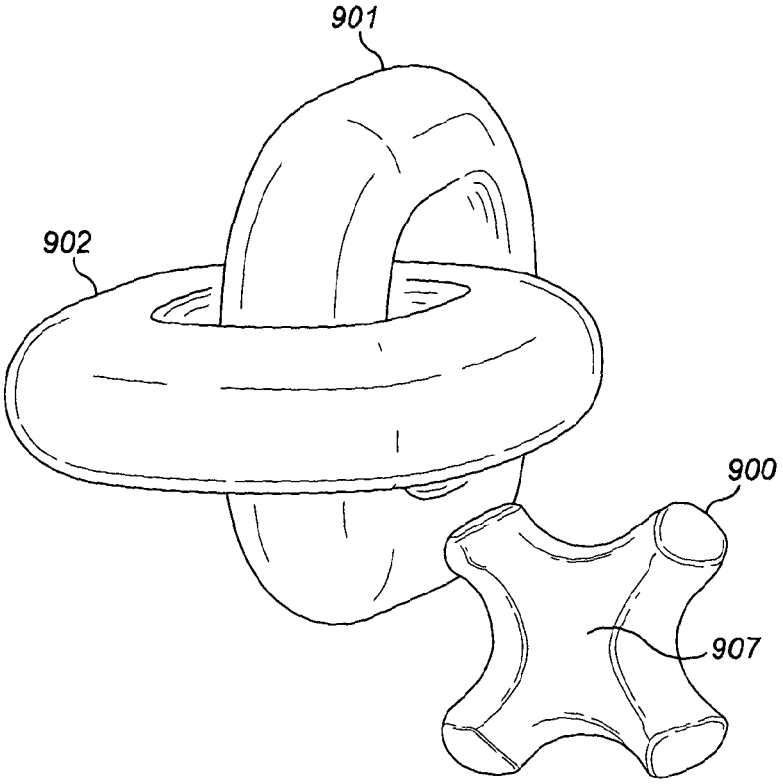
Figure 20:
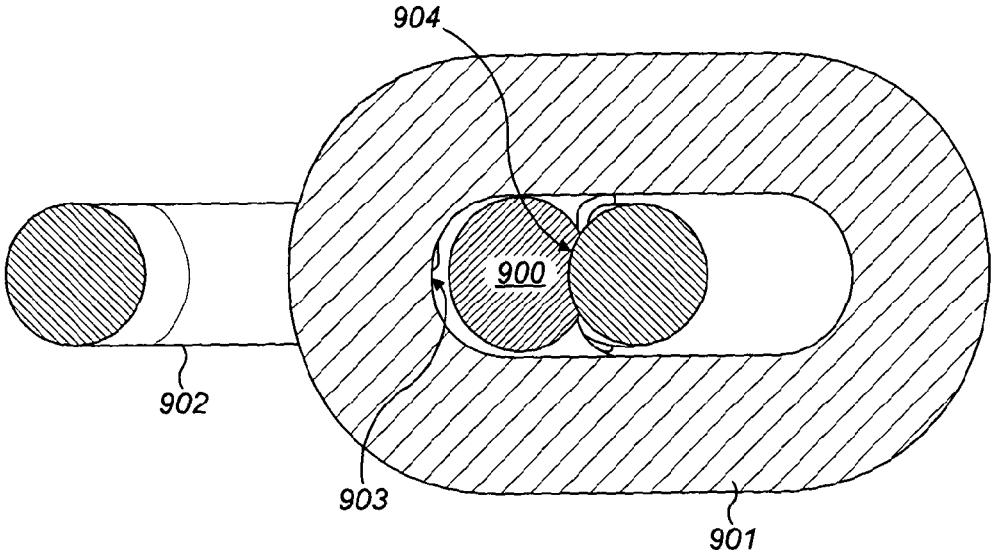
FIG. 20 shows a cross-sectional view of the two successive chain links and shock absorbing apparatus of FIG. 18.

A first example of a shock absorbing insert is illustrated in schematic form in FIG. 18 and further in perspective views in FIG. 19A, 19B and as a cross-section in FIG. 20.

In particular, FIG. 18 shows a shock absorbing insert (900) in position (removably) between opposing bearing surfaces (903, 904) of successive connected links of a chain (901, 902). The shock absorber insert (900) comprises a compressible rubber or polymer-based resilient material having a Shore value exceeding 80. The insert comprises four spaced retention parts (905) extending generally radially from the central load-bearing portion of the insert (906, 907) and adapted and arranged (i.e. shaped) to engage the curved surface portions of the linear side sections of each of the two connected chain links adjacent the bearing surfaces of those links. These outer retention portions of the insert serve to embrace the chain links in question to inhibit or prevent accidental removal of the insert from between the chain links (e.g. falling out). The shock absorber insert has shaped surface parts (906, 907) shaped to correspond reciprocally and in sympathy with the shape of the bearing surfaces of the neighbouring chain links (901, 902) so as to enable an intimate interface between them in use. A first saddle-shaped bearing surface of the shock absorbing insert (906) is sympathetic to the reciprocally shaped inner bearing surface (904) of one or the two connected links (902) while a similarly shaped saddle formation (907) is sympathetic to the reciprocal shape of the opposing bearing surface of the other of the two links (surface 903 of link 901). It will be noted that the orientations of the first and second saddle formations (906, 906) are substantially at right angles to each other in order to correspond with the relative right angular orientation of the two successive chain links with which they are to interface. FIG. 20 illustrates a cross-sectional view of the arrangement illustrated in FIG. 18 illustrating this relationship of shapes and the relative positioning of bearing surfaces of successive chain links and the intermediate bearing portion of the shock absorbing insert sandwiched between those chain bearing surfaces.

Figure 21:
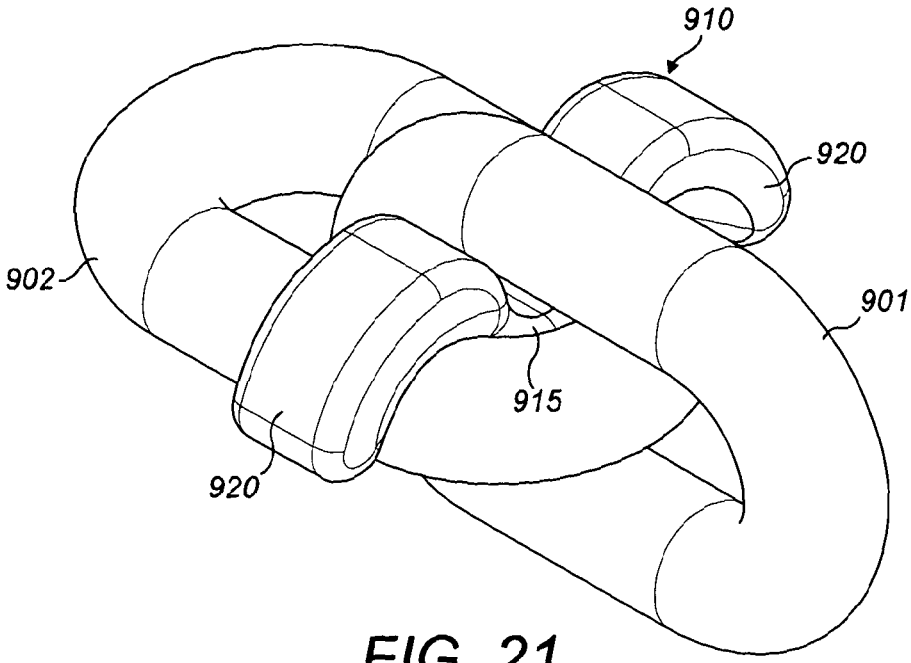
FIG. 21 shows two successive chain links of a chain of the barrier apparatus with a shock absorbing apparatus inserted between opposing bearing surfaces of neighbouring chain links.
Figure 22:
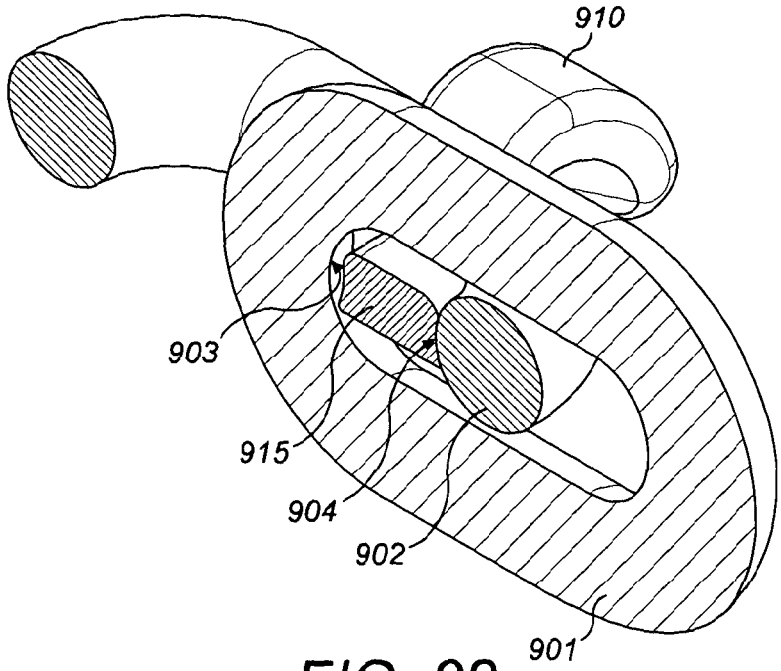
FIG. 22 shows a cross-sectional view of the two successive chain links and shock absorbing apparatus of FIG. 21.
Figure 23A:
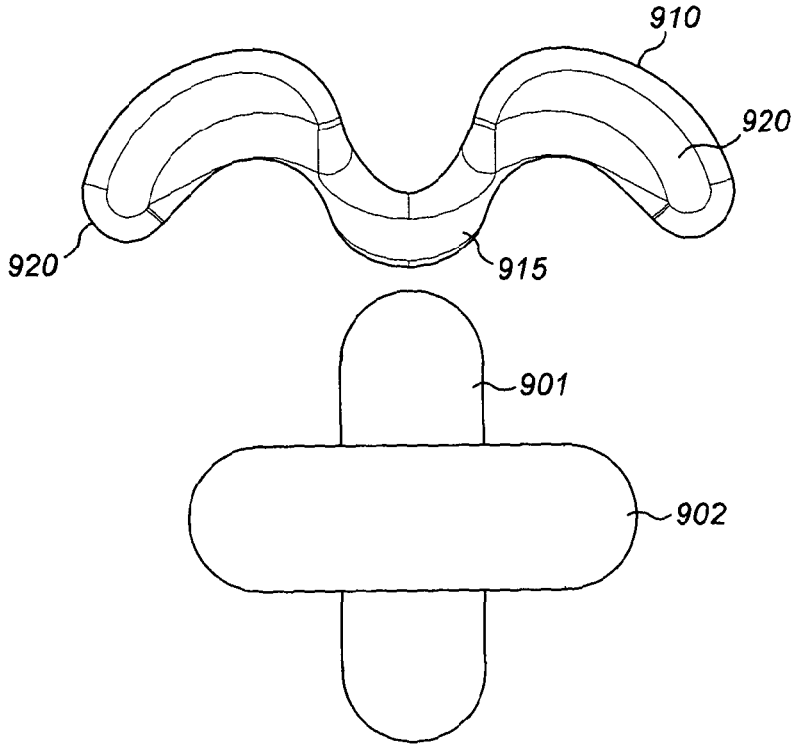
FIGS. 23A, 23B, 23C, and 23D each show the two successive chain links of a chain of the barrier apparatus of FIG. 21 with the shock absorbing apparatus removed.
Figure 23B:
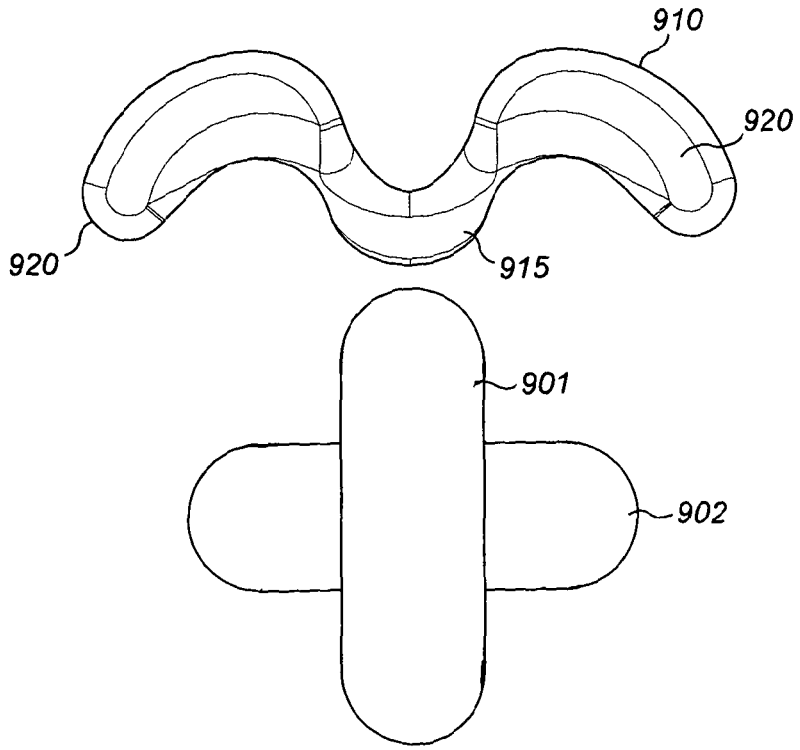
Figure 23C:
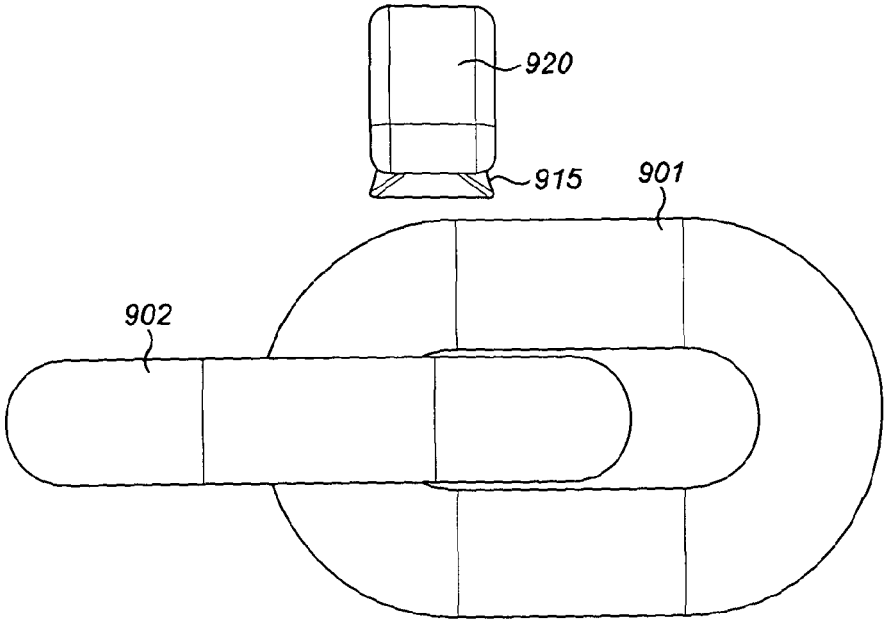
Figure 23D:
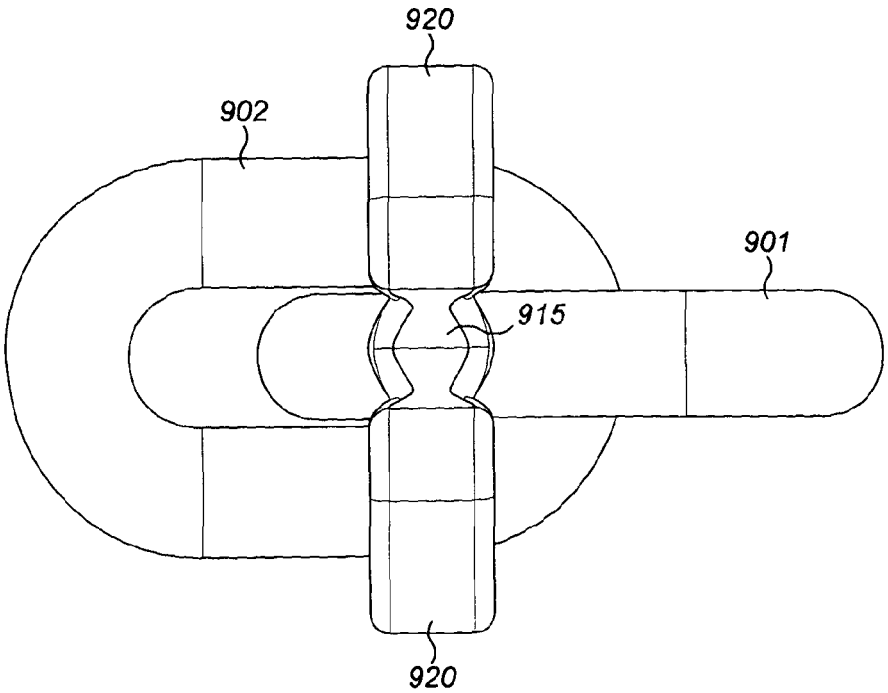
Figure 24:
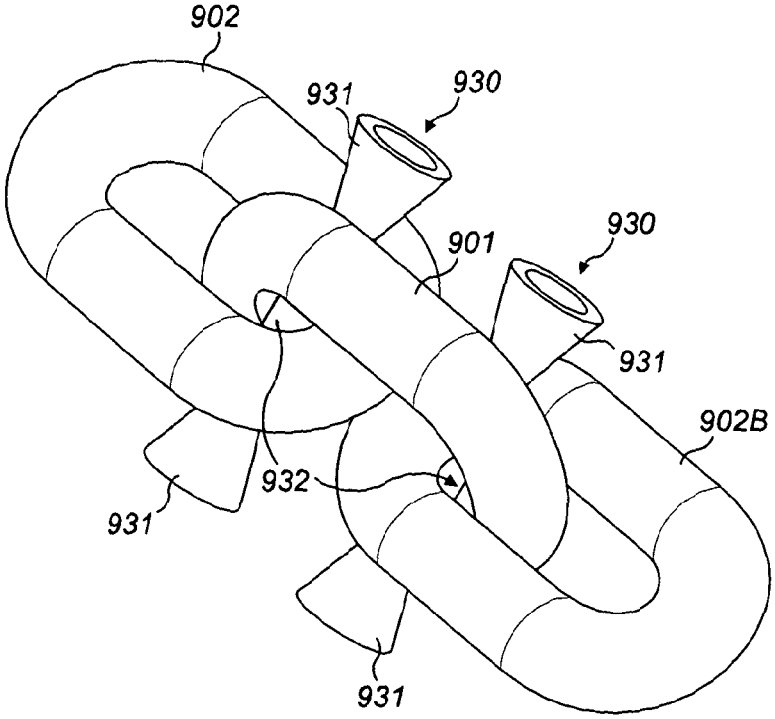
FIG. 24 shows three successive chain links of a chain of the barrier apparatus with shock absorbing apparatus inserted between opposing bearing surfaces of neighbouring chain links.
Figure 25:
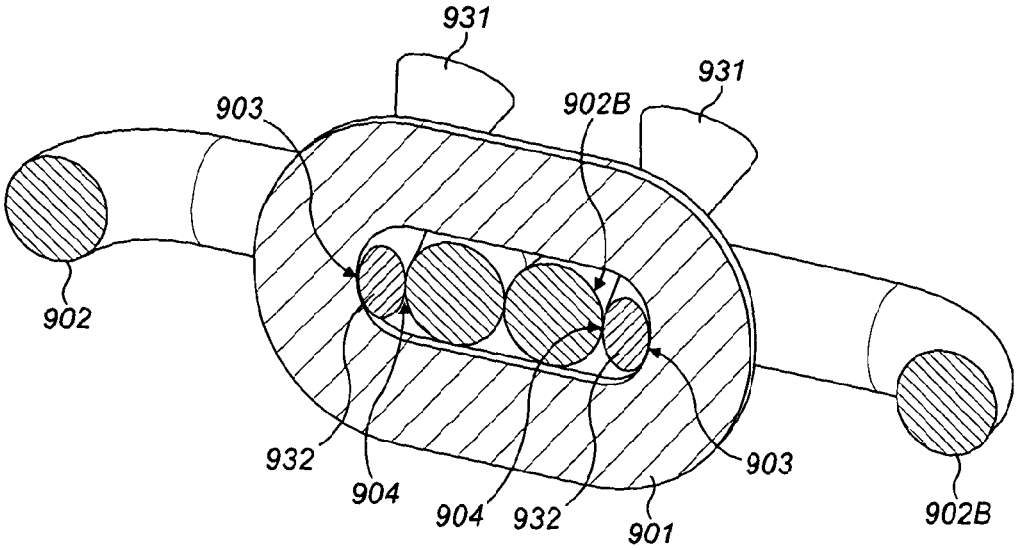
FIG. 25 shows a cross-sectional view of the three successive chain links and shock absorbing apparatus of FIG. 24.
Figure 26A:
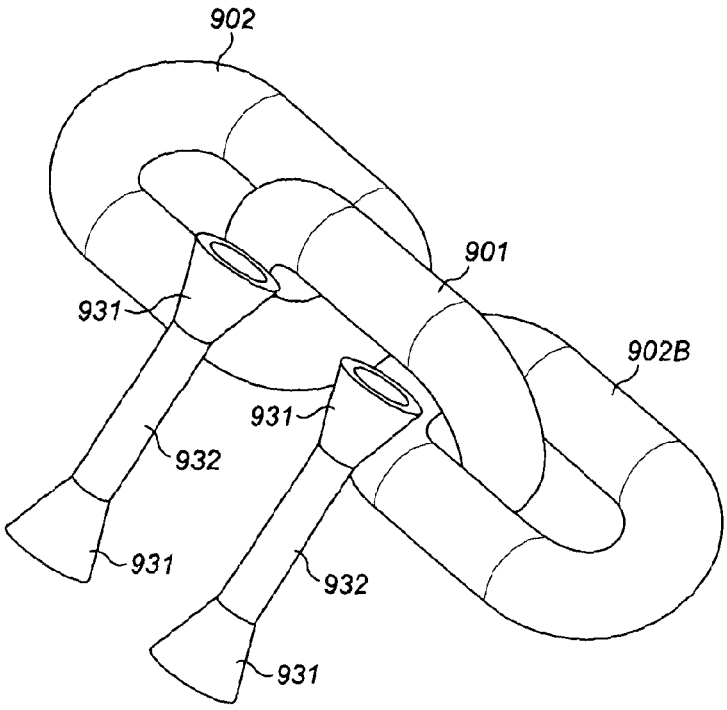
FIGS. 26A, 26B and 26C each show the three successive chain links of a chain of the barrier apparatus of FIG. 24 with the shock absorbing apparatus removed.
Figure 26B:
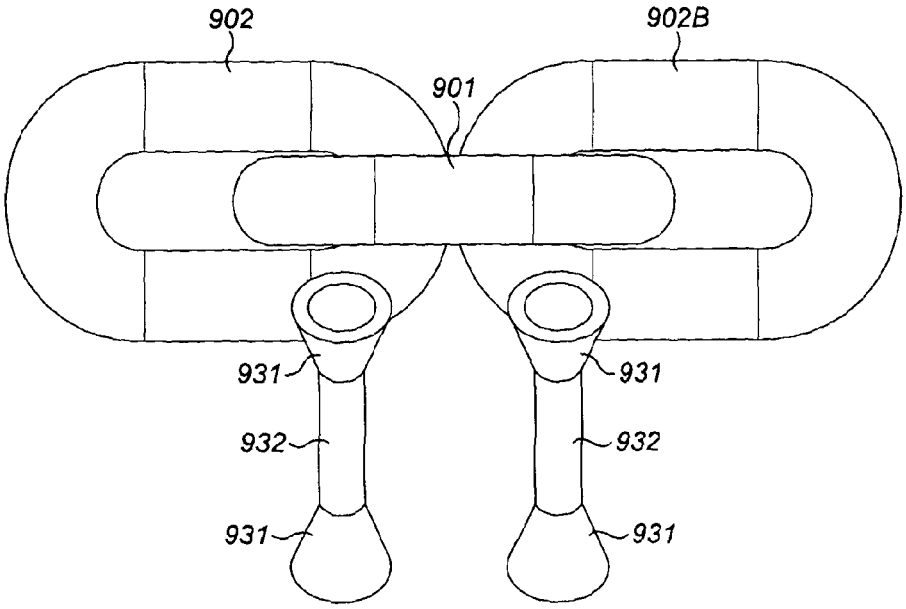
Figure 26C:
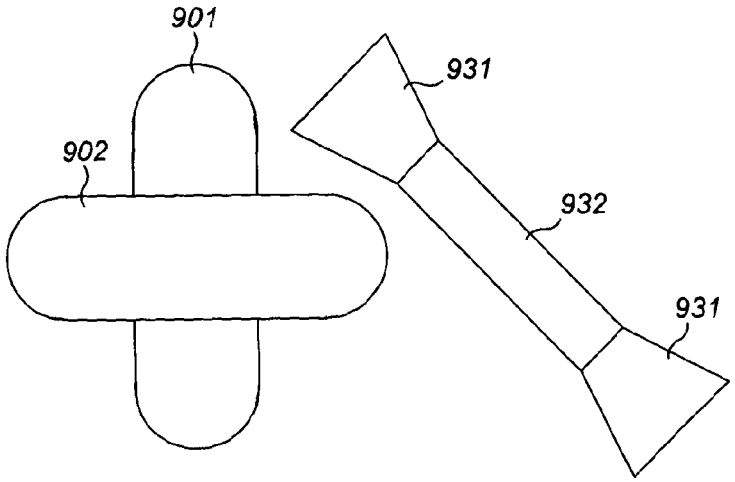

FIG. 21 illustrates an alternative form and structure for such a shock absorbing chain insert. FIG. 22 illustrates the arrangement of FIG. 21 in a cross-sectional form. FIGS. 23A to 23D illustrate the two successive chain links of FIG. 21 with the shock absorbing insert separated from them in a front, back, side and top view respectively. In this example the shock absorbing insert (910) comprises the same material as that of the embodiment illustrated in FIG. 18 in comprising a pair of wings (920) either side of (and extending from) an intermediate load-bearing portion (915) adapted for placement between opposing bearing surfaces (903, 904) of the two linked chain links (902, 901). Each one of the two wing portions (920) extends from an opposite respective side of the intermediate load bearing portion (915) and also presents a respective concavity presented in a direction opposite to that of the direction in which the concavity of the intermediate load bearing portion is presented. The concavity of each of the two wing portions is shaped reciprocally to, and in sympathy with, the generally circularly convex surface shaping of respective parts of the same one of the two chain links (902) of the two linked chain links other than the link (901) with which the intermediate load bearing portion is in sympathy. That is to say, the concavity of the intermediate load bearing portion (915) is adapted to sympathetically receive part of a first of the two chain links (901) while each of the two concavities in the respective two wing portions (920) on either side of the intermediate load bearing portion (915) of the insert is adapted to concurrently accept opposite portions/sides of the other of the two linked chain links (902).

FIG. 24 and FIGS. 25 and 26A to 26C show a perspective view, a cross-sectional view and a sequence of subsequent views of a third example of a shock absorber insert apparatus. The shock absorber apparatus comprises a shaft of material such as the material employed for either of the shock absorber inserts illustrated in FIGS. 18 and 21, or formed from a steel tube compressible transversely (i.e. collapsible) under sufficient transverse compression force as between opposing bearing surfaces of neighbouring chain links. In the example illustrated, the shaft comprises a solid intermediate shaft portion (932) formed from a polymer or rubber material of Shore value in excess of 80. Such materials would be readily apparent to the skilled person. The shaft is circular in cross-section and of sufficient length to allow it to extend fully from one side of a chain link (e.g. 902B) obliquely through the through-opening of that link and out beyond the other side of the link, and concurrently to do the same with the neighbouring chain link (901) which also passes through the former through-opening of the former chain link. In this way, the circular shaft portion of the shock absorber insert obliquely passes through the through-openings of each of two successive linked chain links so as to have a middle portion positioned directly inbetween the opposing bearing surfaces (903, 904) of the two opposing chain links.

The terminal ends of the shock absorber insert comprise retention parts (931) formed as expanded terminal portions of the shock absorber insert apparatus. Each is shaped as a circular-conical frustrum expanding, at its narrower end, from the endmost parts of the intermediate circular rod (932) of the insert to its widest conical width at the terminal respective end of the shock absorber apparatus. Each of these two terminal frustrums is hollow and presents a circular cavity opening at its cone base, the cavity being conical and extending into the body of the frustum to define frustum walls of desired width. Consequently, the frustum walls are of a thickness chosen so as to be manually compressable between finger and thumb to allow the wider terminal parts of the frustrum to be squashed or compressed to a certain extent to reduce size to assist in the insertion thereof between the chain link parts when inserting the shock absorber insert.

FIGS. 27 to 31 each illustrate a bollard apparatus (1000) for use as a vehicle barrier comprising a bollard member (1001) fixed to a foot assembly (1002) for ground engagement by placement upon, or embedment within, a ground or floor surface. The bollard member is upstanding from the foot assembly. The foot assembly comprises a pair of opposed parallel plates (1003,1004) of substantially identical shape separated by six coupling beams (1005) which are each fixed to both of the opposed plates and are sandwiched between them. A first pair (1006) of coupling beams extend in parallel adjacent a first edge (1007) of a foot assembly to define between them a spacing (1008) accessible by, and adapted for receiving an end of a first separate coupling beam extending adjacent an edge of a separate other such foot assembly. A second pair (1009) of coupling beams extend in parallel adjacent the first edge (1007) of a foot assembly to define between them a spacing (1010) accessible by, and adapted for receiving an end of a second separate coupling beam extending adjacent an edge of the same separate other such foot assembly. A first and second separate coupling beams (1011, 1012) extend adjacent a second edge of the foot assembly. These are each adapted separately to be received between respective pairs of parallel coupling beams of a common other foot assembly to couple thereto.

A linkage pin (1013) is provided for linking each of the pair of coupling beams to an end of a separate coupling beam when so received thereby to couple any one of the foot assemblies of FIGS. 27 to 32 to another foot assembly of any of FIGS. 27 to 32. Each coupling beam comprises a through-opening. The linkage pin is adapted to extend concurrently through the through-openings of each of the coupling beams of any pair of coupling beams of one foot assembly and of any separate coupling beam of another foot assembly when so received. Consequently, a firm linkage passes from one coupling beam of a pair to the other coupling beam of the pair to firmly and strongly hold the pin as it concurrently passes through the received other coupling beam.

Figure 29:
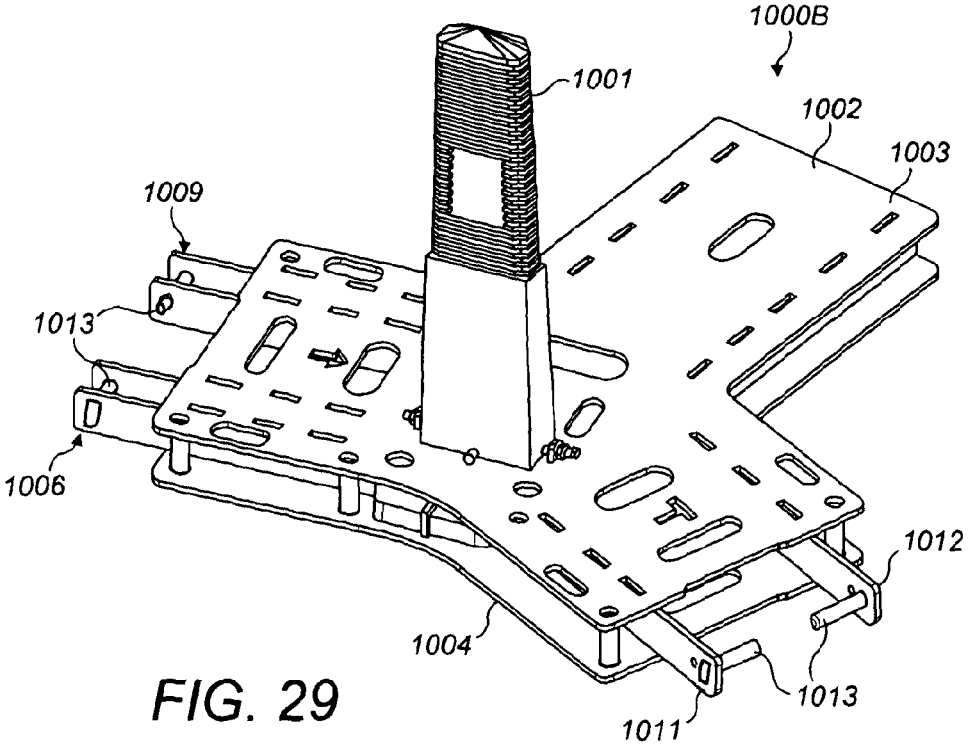
FIGS. 29, 30, 31A to 31C and 32A to 32C show additional barrier units adapted to be coupled to each other and/or to the barrier unit FIG. 27.
Figure 30:
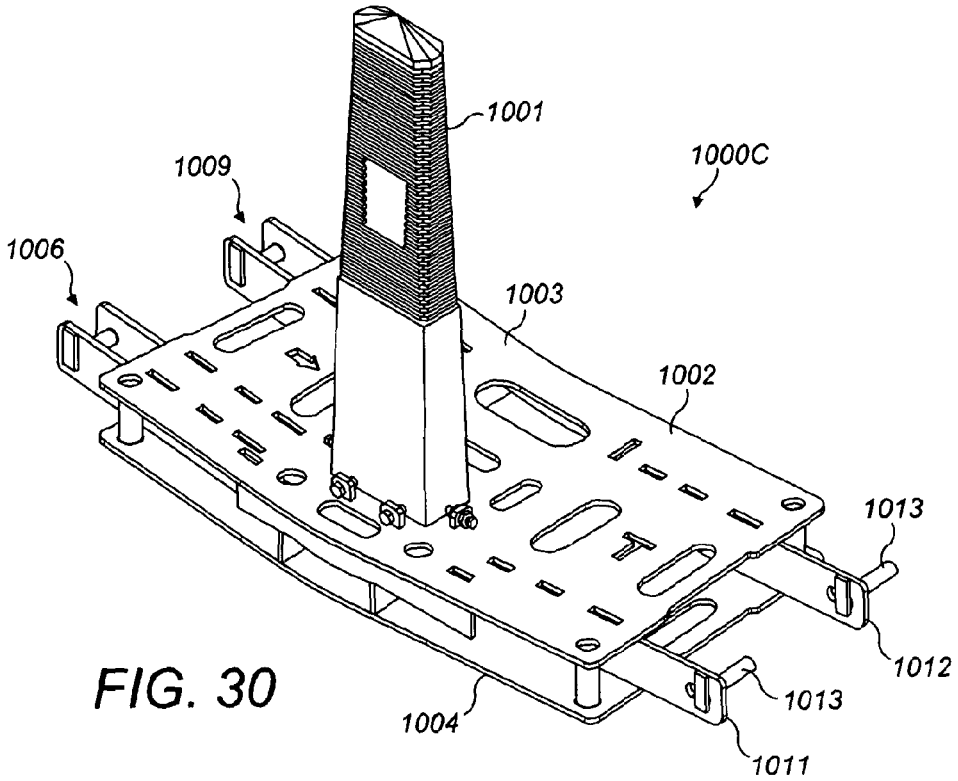
Figure 31A:
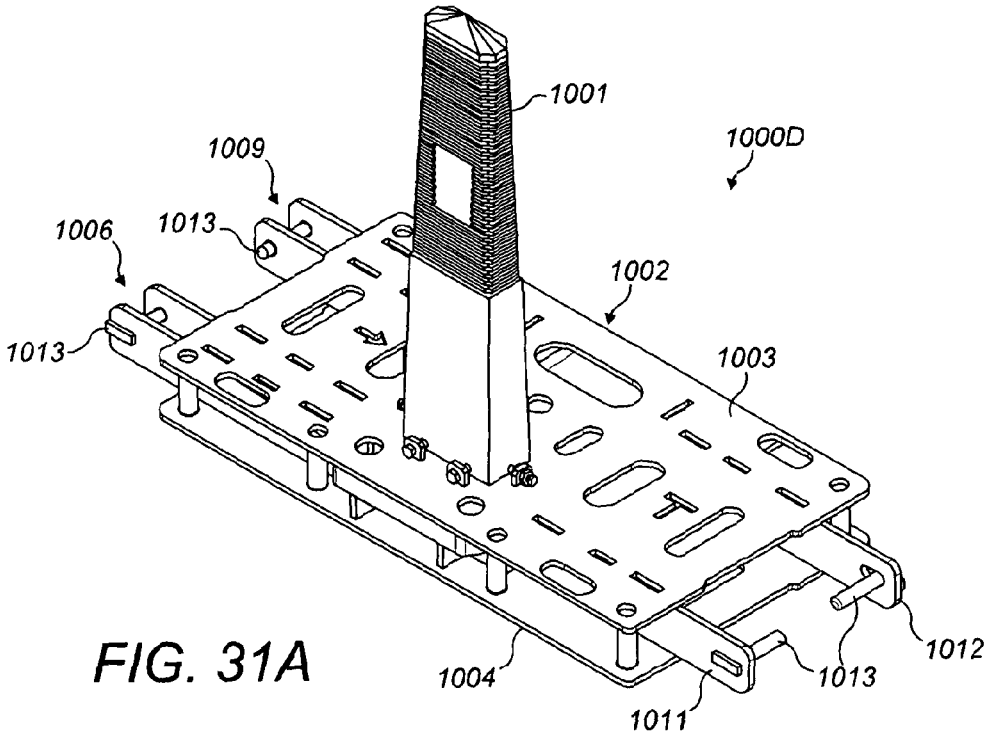
Figure 31B:
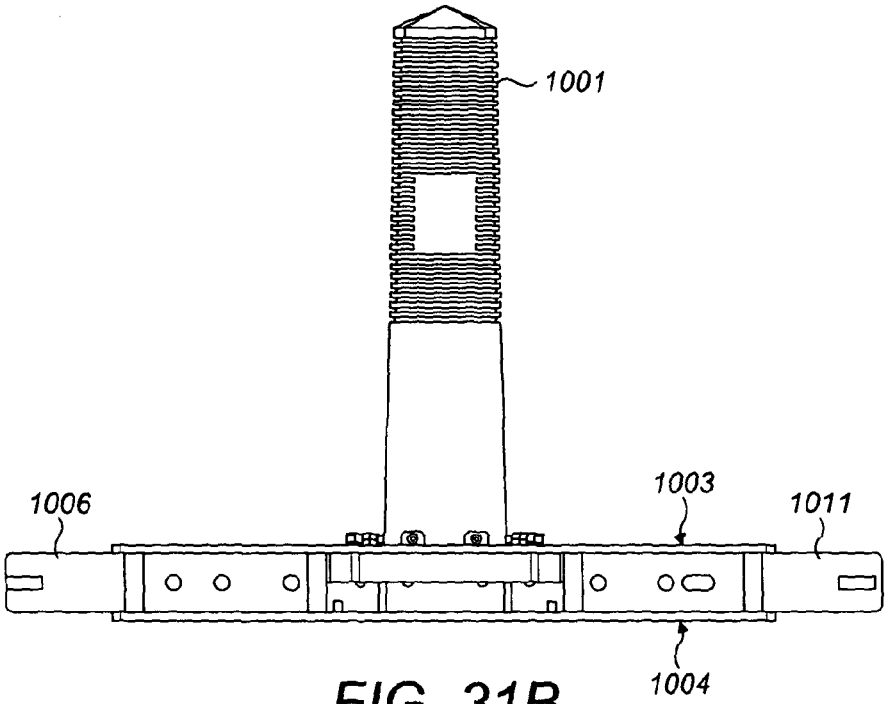
Figure 31C:
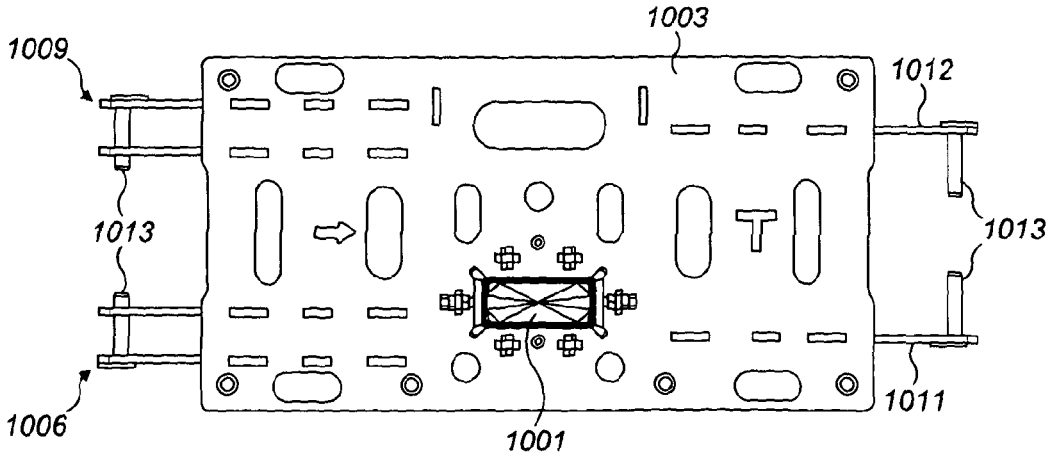

Each foot assembly of the bollard apparatuses of FIGS. 29 to 31 comprises two separate pairs of coupling beams (1006, 1009) extending adjacent a common edge (1007) thereof. Each foot assembly of the bollard apparatuses of FIGS. 29 to 32 also comprises a two separate coupling beams (1012, 1011) extending adjacent a common separate edge thereof (1014).

The coupling beams of the two separate said pairs of coupling beams (1006,1009) are substantially mutually parallel, and the two separate coupling beams (1011, 1012) are substantially mutually parallel. However, in some foot assemblies, such as in FIGS. 29 and 30, the coupling beams of the two separate pairs of coupling beams extend in a direction oblique relative to the direction in which the two separate coupling beams extend. In other foot assemblies, as shown in FIGS. 27, 28 and 31, the coupling beams of the two separate said pairs of coupling beams extend in a direction substantially parallel to the direction in which the two separate coupling beams extend.

Figure 32A:
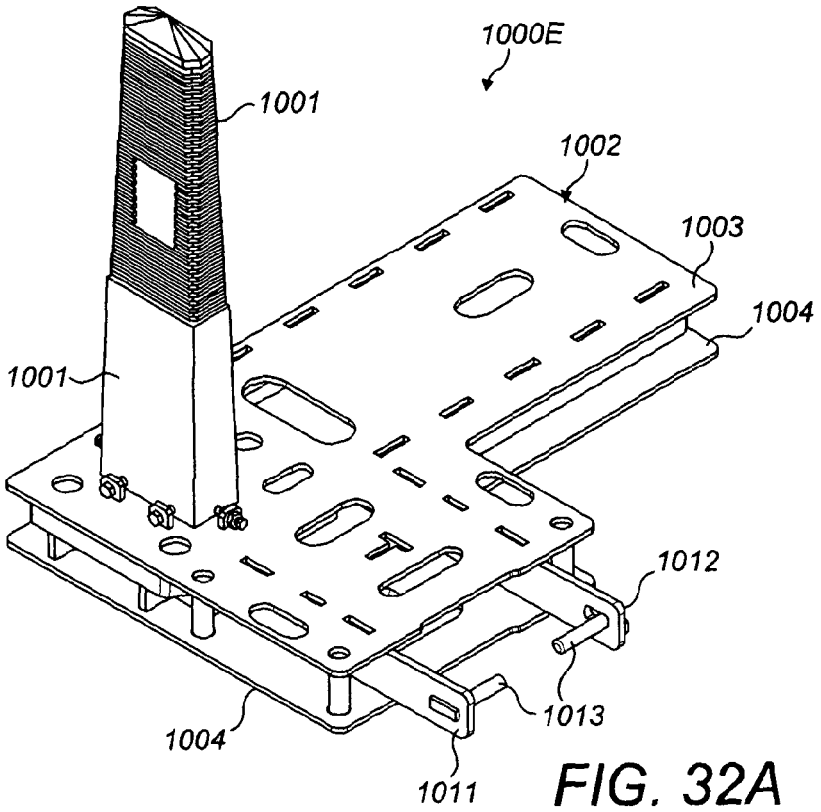
Figure 32B:
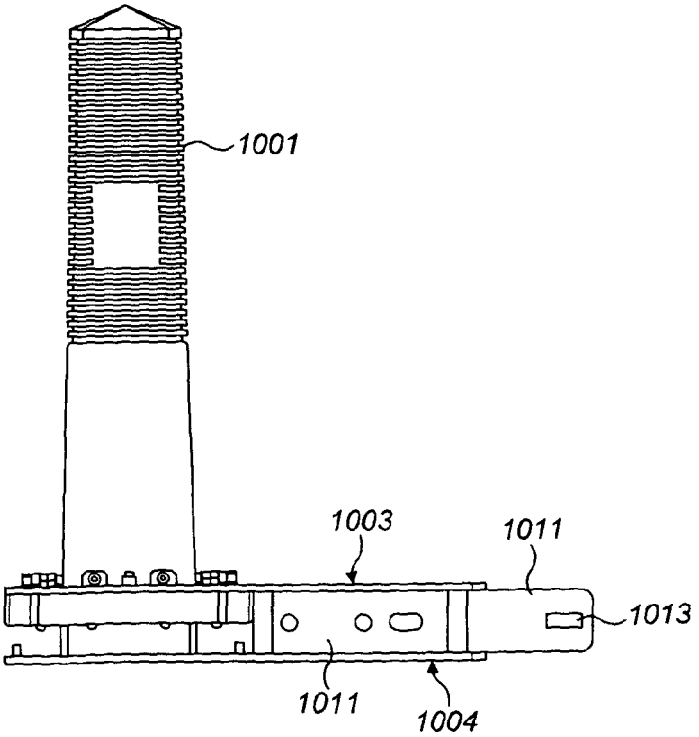
Figure 32C:
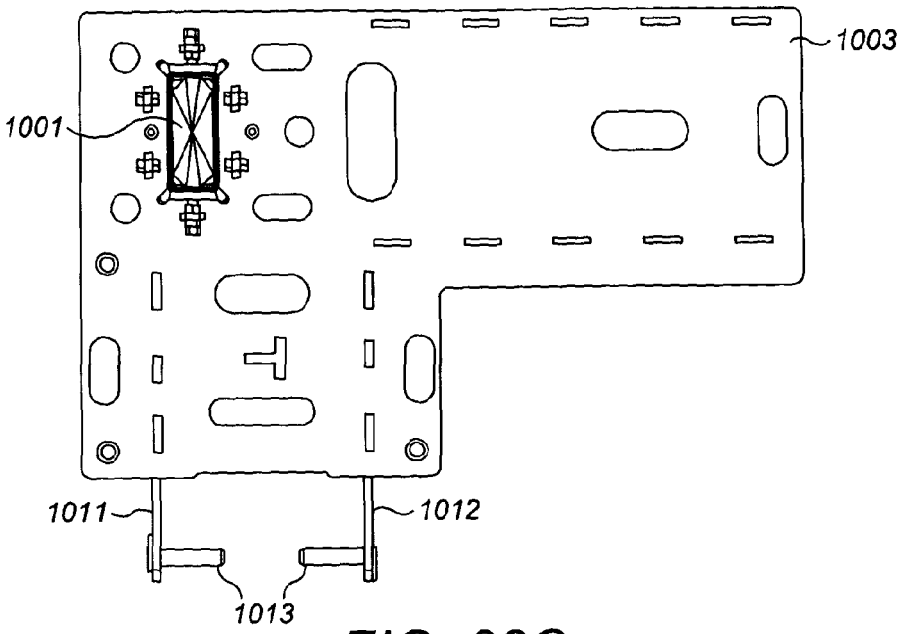
Figure 33A:
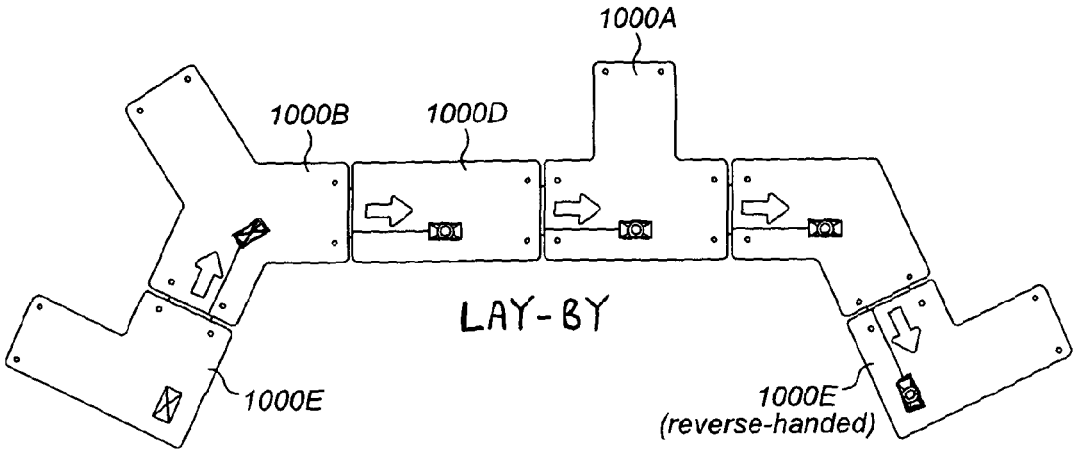
FIGS. 33A and 33B show barriers composed of a plurality of barrier units selected from the different barrier units of FIGS. 27 to 32C.
Figure 33B:
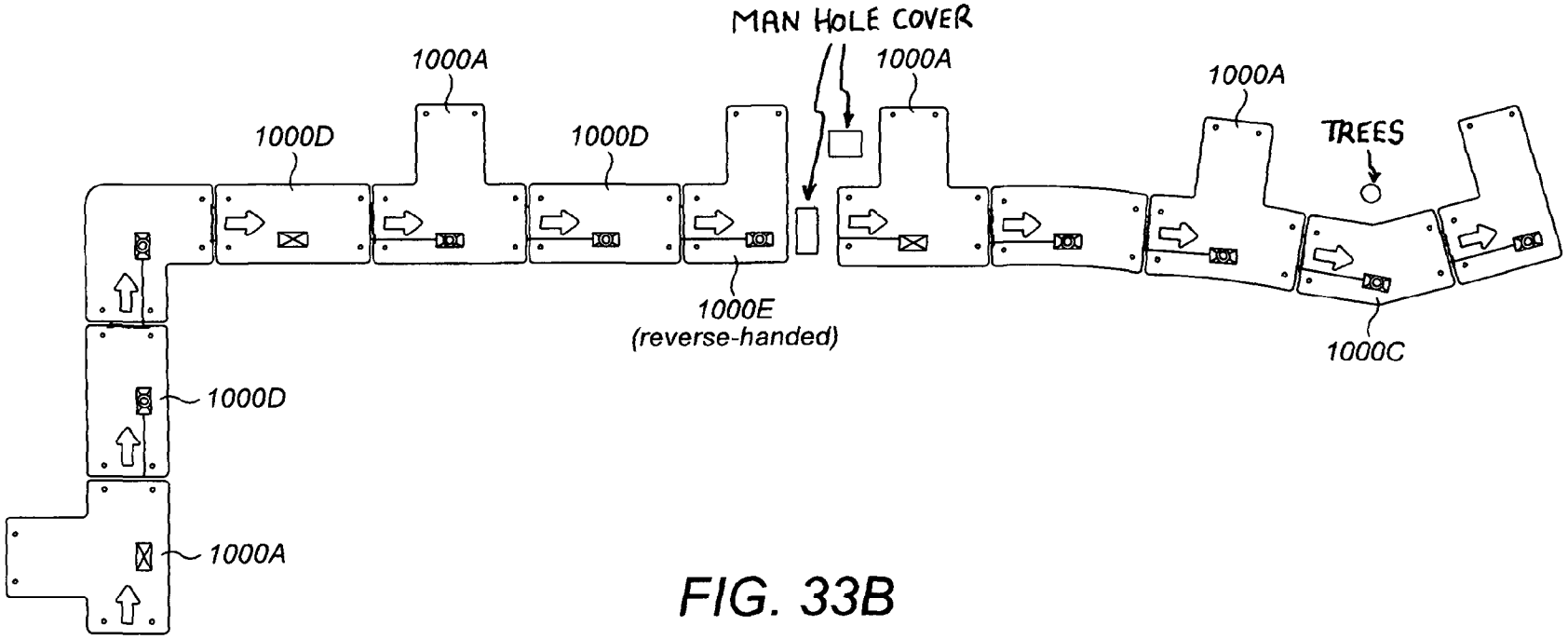

A barrier may comprise a mixture of such bollard apparatuses having different coupling beam orientations to enable deviations from linearity in the path of the barrier formed from the assemblies. FIGS. 32A and 32B show examples of this in which obstacles such as trees, lay-bys and corners may be accounted for by selecting a barrier unit with the appropriate foot assembly to permit the deviation in the path of the barrier as required to avoid the obstacle.

Figure 27:
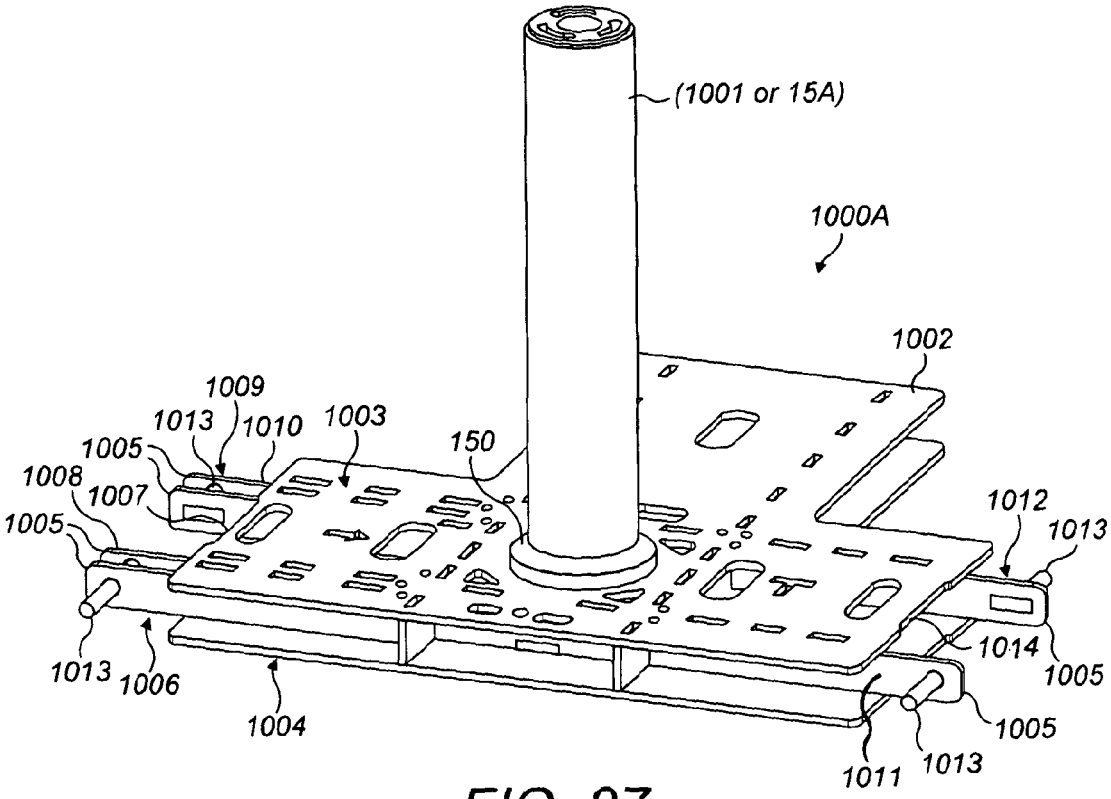
FIGS. 27 and 28 show a perspective view and a cross-sectional view of a barrier unit.
Figure 28:
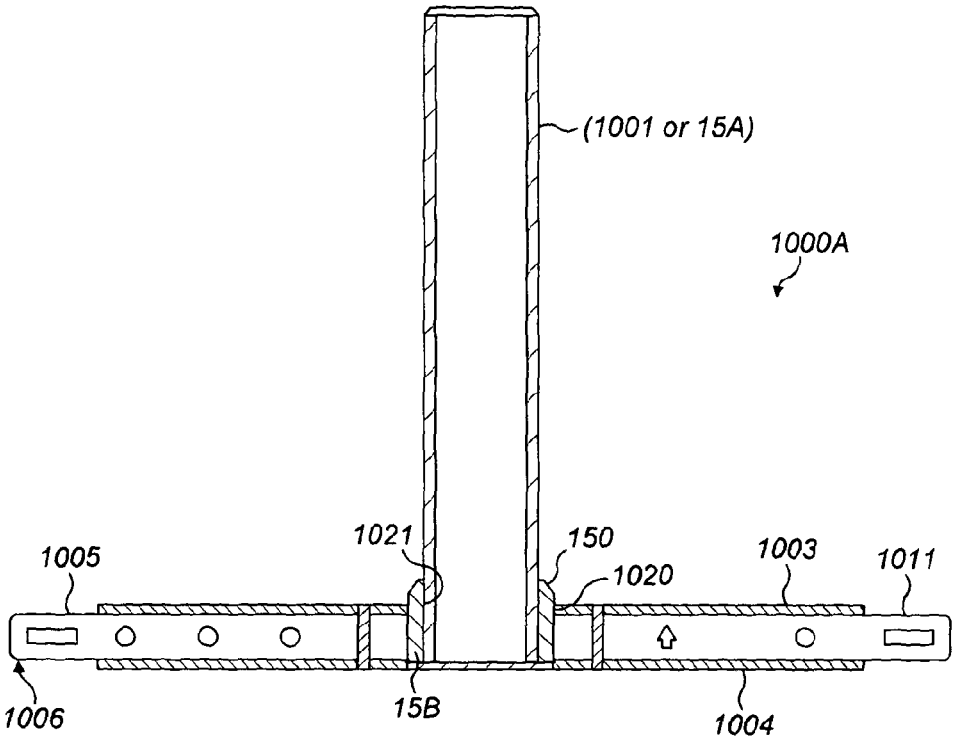

FIGS. 27 and 28 show an example of a barrier unit in which one of the pair of opposed plates (1003) of the foot assembly of the unit uppermost in use defines a through-opening (1020) through which a bollard (1001) member extends from between the opposed plates. The bollard is upstanding from the surface of foot assembly uppermost in use. FIG. 28 shows the barrier unit if FIG. 27 in cross-section. The collar member 15B is fixed to the base end of a bollard member by welding as described with reference to FIG. 14A to 14C. It circumscribes the bollard member at its base and is positioned within the through-opening to be upstanding from the surface (1003) of foot assembly from which the bollard member is also upstanding. In particular, the collar member defines a bore (1021) along which the bollard member is fitted. The outer diameter of the collar member at parts (150) adjacent the head end of the bore furthest from the through-opening, is less than the outer diameter at parts thereof adjacent the through-opening. The advantages of this are as described above with reference to FIG. 14A to 14C.

Although a few preferred embodiments have been shown and described, it will be appreciated by those skilled in the art that various changes and modifications might be made without departing from the scope of the invention, as defined in the appended claims.

The invention claimed is:

1. A bollard apparatus for use as a vehicle barrier including:

one or more bollard members;

one or more separate foot members each adapted for ground engagement by placement upon, or embedment within, a ground or floor surface, to each of which is fixed at least one said bollard member upstanding therefrom;

at least one collar member positioned within a respective through-opening in a respective foot member wherein the collar member is welded to the base end of a bollard member and circumscribes the bollard member thereat and wherein the collar member is welded to the foot member and is upstanding from the surface of foot member from which the bollard member is also upstanding.

2. A bollard apparatus of claim 1 in which the collar member defines a bore along which the bollard member is fitted, wherein the outer diameter of the collar member at parts adjacent the head end of the bore furthest from the through-opening, is less than the outer diameter at parts thereof adjacent the through-opening.

3. A bollard apparatus of claim 2 in which the outer diameter of parts of the collar member decrease with increasing proximity to the head end thereof progressively, thereby to define a tapering.

4. A bollard apparatus according to claim 2 wherein the outer diameter of the collar member is least at the head end thereof.

5. A bollard apparatus according to claim 1 comprising a plurality of said bollard members each bearing a collar member positioned within a respective through-opening in a respective foot member.

6. A bollard apparatus according to claim 1 including a plurality of bollard members, a plurality of separate said foot members each adapted for ground engagement by placement upon (or embedment within) a ground or floor surface, to each of which is fixed at least one said bollard member upstanding therefrom.

7. A vehicle impact barrier or a part thereof, comprising a bollard apparatus according to claim 1.

8. A bollard apparatus for use as a vehicle barrier comprising:

one or more bollard members;

a plurality of separate foot assemblies each adapted for ground engagement by placement upon, or embedment within, a ground or floor surface, to at least one of which is fixed at least one said bollard member upstanding therefrom;

and each said foot assembly comprises a pair of opposed parallel plates separated by a plurality of coupling beams which are each fixed to both of the opposed plates and are sandwiched therebetween;

wherein a pair of said coupling beams extend in parallel adjacent an edge of a foot assembly of the plurality of foot assemblies and define between them a spacing accessible at said edge and adapted for receiving an end of a separate coupling beam extending adjacent an edge of a separate other said foot assembly;

and a linkage member for linking each of said pair of coupling beams to an end of said separate coupling beam when so received thereby to couple the two foot assemblies.

9. A bollard apparatus according to claim 8 in which each said coupling beam comprises a through-opening and said linkage means comprises a pin member adapted to extend concurrently through the through-openings of each of the coupling beams of the pair of coupling beams and of the separate coupling beam when so received.

10. A bollard apparatus according to claim 8 in which each foot assembly comprises a said pair of coupling beams extending adjacent an edge thereof, and said separate coupling beam extending adjacent a separate edge thereof.

11. A bollard apparatus according to claim 10 in which each foot assembly comprises two separate said pairs of coupling beams extending adjacent a common edge thereof, and two said separate coupling beams extending adjacent a common separate edge thereof.

12. A bollard apparatus according to claim 11 comprising a foot assembly in which the coupling beams of said two separate said pairs of coupling beams are substantially mutually parallel, and said two separate coupling beams are substantially mutually parallel.

13. A bollard apparatus according to claim 12 comprising a foot assembly in which the coupling beams of said two separate said pairs of coupling beams extend in a direction oblique relative to the direction in which said two separate coupling beams extend.

14. A bollard apparatus according to claim 12 comprising a foot assembly in which the coupling beams of said two separate said pairs of coupling beams extend in a direction substantially parallel to the direction in which said two separate coupling beams extend.

15. A bollard apparatus according to claim 8 in which one of said pair of opposed plates uppermost in use defines a through-opening through which a said bollard member extends from between the opposed plates so as to be upstanding from the surface of foot assembly uppermost in use.

16. A bollard apparatus according claim 15 including at least one collar member fixed to the base end of a bollard member and circumscribing the bollard member thereat, the collar member being positioned within said through-opening to be upstanding from the surface of foot assembly from which the bollard member is also upstanding.

17. A bollard apparatus of claim 16 in which the collar member defines a bore along which the bollard member is fitted, wherein the outer diameter of the collar member at parts adjacent the head end of the bore furthest from the through-opening, is less than the outer diameter at parts thereof adjacent the through-opening.

18. A vehicle impact barrier or a part thereof, comprising a bollard apparatus according to claim 8.

* * * * *